US005470529A

United States Patent [19]

Nomura et al.

[11] Patent Number: 5,470,529

[45] Date of Patent: Nov. 28, 1995

[54] HIGH TENSILE STRENGTH STEEL SHEET HAVING IMPROVED FORMABILITY

[75] Inventors: Shigeki Nomura, Ibaraki; Nozomi Komatsubara, Nishinomiya; Naomitsu Mizui, Amagasaki; Kazutoshi Kunishige, Kawanishi; Tomoki Fukagawa, Amagasaki, all of Japan

[73] Assignee: Sumitomo Metal Industries, Ltd., Osaka, Japan

[21] Appl. No.: 207,098

[22] Filed: Mar. 8, 1994

[51] Int. Cl.[6] ..... C22C 38/06

[52] U.S. Cl. ..... 420/103; 148/320; 148/333

[58] Field of Search ..... 420/103; 148/320, 148/333, 603

[56] References Cited

U.S. PATENT DOCUMENTS

| | | |
|---|---|---|
| 5,017,248 | 5/1991 | Kawano et al. . |
| 5,030,298 | 7/1991 | Kawano et al. . |

FOREIGN PATENT DOCUMENTS

| | | |
|---|---|---|
| 55-44551 | 3/1980 | Japan . |
| 55-145121 | 11/1980 | Japan . |
| 61-157625 | 7/1986 | Japan . |
| 62-35461 | 8/1987 | Japan . |
| 63-4017 | 1/1988 | Japan . |
| 64-79322 | 3/1989 | Japan . |
| 1-159317 | 6/1989 | Japan . |
| 4-28820 | 1/1992 | Japan . |
| 4-333524 | 11/1992 | Japan . |
| 4-341523 | 11/1992 | Japan . |
| 4-371528 | 12/1992 | Japan . |
| 5-59492 | 3/1993 | Japan . |

*Primary Examiner*—Deborah Yee

*Attorney, Agent, or Firm*—Burns, Doane, Swecker & Mathis

[57] ABSTRACT

A high tensile strength, hot or cold rolled steel sheet having improved ductility and hole expandability consists essentially, on a weight basis, of: C: 0.05–0.3%, Si: 2.5% or less, Mn: 0.05–4%, Al: greater than 0.10% and not greater than 2.0% wherein $0.5 \leqq Si(\%)+Al(\%) \leqq 3.0$, optionally one or more of Cu, Ni, Cr, Ca, Zr, rare earth metals (REM), Nb, Ti, and V, and a balance of Fe and inevitable impurites with N being limited to 0.01% or less. The steel sheet has a structure comprising at least 5% by volume of retained austenite in ferrite or in ferrite and bainite. A hot rolled steel sheet is produced by hot rolling with a finish rolling end temperature in the range of 780°–840° C., cooling to a coiling temperature in the range of 300°–450° C. either by rapid cooling to the coiling temperature at a rate of 10°–50° C./sec or by initial rapid cooling to a temperature range of 600°–700° C., then air-cooling for 2–10 seconds, and final rapid cooling to the coiling temperature. A cold rolled steel sheet is produced by hot rolling, cooling to a coiling temperature in the range of 300°–720° C., descaling, cold rolling with a reduction of 30–80%, and annealing. Annealing is performed by heating between the $Ac_1$ point and the $Ac_3$ point and cooling such that the temperature is either kept for at least 30 seconds in the range of 550° C. to 350° C. or slowly decreased at a rate of 400° C./min or less in that temperature range.

45 Claims, 2 Drawing Sheets

HIGH TENSILE STRENGTH STEEL SHEET HAVING IMPROVED FORMABILITY

BACKGROUND OF THE INVENTION

This invention relates to a high tensile strength steel sheet having improved formability including increased ductility and improved hole expandability and which is suitable for use as structural or high strength parts to be shaped by press forming or flange forming in automobiles, industrial machinery and equipment, and the like.

In order to make automobiles, industrial machinery, or other equipment lighter, there have been developed many techniques to increase the strength of steel sheets. However, an increase in strength of a steel sheet is normally accompanied by a decrease in its ductility or formability. Therefore, it is difficult to produce a steel sheet having both good formability and high strength.

Among hot rolled steel sheets, those of dual phase steels described in Japanese Patent Application Kokai (Laid-Open) No. 55-44551 (1980), for example, are known to have high strength and good formability. Dual phase steels have a mixed ferritic and martensitic structure and are characterized by having a low yield ratio and high ductility. However, in the case of 60 kilo-grade high tensile strength steels which have a tensile strength (TS) on the order of 60 kgf/mm$^2$ or 590 MPa, their elongation (El) is about 30% at highest and their strength-ductility balance (TSxEl) is less than 20,000 (in MPa-%). In the case of 80 kilo-grade high tensile strength steels which have a tensile strength on the order of 80 kgf/mm$^2$ or 790 MPa, their elongation is about 20% at highest and their strength-ductility balance is less than 18,000 (in MPa-%). A further increase in ductility cannot be achieved with dual phase steels.

It is known that transformation-induced plasticity (abbreviated as TRIP) caused by a retained austenite phase can be utilized to significantly increase the ductility of a high strength steel sheet which may be either a hot or cold rolled steel sheet. TRIP is observed in an Si- and Mn-containing carbon steel sheet having a mixed three-phase structure composed of ferrite, bainite, and retained austenite phases by partial transformation of austenite into bainite during cooling after hot rolling or after heating for annealing. It is the phenomenon that stress-induced transformation of the retained austenite phase occurs during deformation of the steel for forming that causes the steel to exhibit a remarkably high elongation.

A hot rolled steel sheet capable of utilizing the TRIP phenomenon is described in Japanese Patent Application Kokai No. 55-145121 (1980), for example. The steel sheet contains 0.40–0.85% C. (all percents concerning steel chemical compositions being by weight in the present specification), and it is produced by subjecting the hot rolled steel sheet to rapid cooling from a temperature in the austenite region to a temperature in the range of 380° C. to 480° C., at which temperature the steel sheet is then kept for a period sufficient to transform the majority of austenite into bainite, thereby forming the above-described mixed three-phase structure. The resulting hot rolled steel sheet has high strength and good ductility, probably on the order of at least 1100 MPa in TS, at least 22% in El, and a value for TSxEl in excess of 23,500. However, due to the relatively high carbon content in the range of 0.40% to 0.85%, the weldability of the hot rolled steel sheet is too low to be useful in the manufacture of automobiles and structural parts.

A cold rolled, high tensile strength steel sheet capable of utilizing the TRIP phenomenon and having high ductility is described in Japanese Patent Application Kokai No. 61-157625 (1986), for example. It contains 0.4–1.8% Si, 0.2–2.5% Mn, and optionally one or more of P, Ni, Cu, Cr, Ti, Nb, V, and Mo in appropriate amounts. It is produced by subjecting the cold-rolled steel sheet to annealing in such a manner that it is heated at a temperature in the intercritial region followed by cooling, during which the steel sheet is kept for a period of from 30 seconds to 30 minutes at a temperature in the range of 500° C. down to 350° C. to form mixed three phase structure of ferrite, bainite, and retained austenite phases.

Japanese Patent Publication No. 62-35461 (1987) describes a process for producing a high tensile strength steel sheet which has a structure comprising at least 10% by volume of a mixed ferrite and retained austenite phase in a martensitic or bainitic matrix. The process comprises heating a steel sheet containing 0.7–2.0% Si and 0.5–2.0% Mn at a temperature in the intercritical region followed by cooling, during which the steel sheet is kept for 10 to 50 seconds at a temperature in the range of 650° C. to 450° C.

Other disclosures of a hot rolled or cold rolled steel sheet having a structure which contains a retained austenite phase and exhibiting good ductility include U.S. Pat. Nos. 5,017,248 and 5,030,208, and Japanese Patent Applications Kokai Nos. 63-4017 (1988), 64-79322 (1989), 1-159317 (1989), 4-28820 (1992), 4-333524 (1992), 4-371528 (1992), and 5-59492 (1993).

However, these high ductility, high tensile strength steel sheets capable of utilizing the TRIP phenomenon of retained austenite, whether hot or cold rolled, have the common drawback that despite their good ductility or high elongation in a tensile test, their press formability is not always improved to a degree predictable from the ductility level so that they cannot be successfully used in fabrication by press forming. It is believed that such deterioration in press formability is attributable to the fact that the local ductility in the press-formed area is greatly deteriorated at a late stage of deformation in press forming, since most of the retained austenite phase has already been transformed into high-carbon martensite by stress-induced transformation before that time. This is particularly significant in flange forming, including hole expansion. As a result, the hole expandability of these steel sheets is inferior to that of conventional high tensile strength, cold rolled steel sheets of the low carbon type. This is considered to be caused by a high-carbon martensite phase formed by stress-induced transformation during punching for forming an initial hole to be expanded. The high hardness of the martensite phase causes the formation of minute cracks around the initial hole, which are extended or propagated in the subsequent hole expansion stage, thereby deteriorating the hole expandability.

In conventional processes for producing steel sheets having the above-described mixed three-phase structure, a change of strength level of a steel sheet is inevitably accompanied by a change in carbon content. However, a decrease in carbon content leads to a decrease in volume fraction of retained austenite in the steel, which makes it difficult to improve the ductility of the steel sufficiently by the TRIP phenomenon.

Japanese Patent Application Kokai No. 4-341523 (1992) discloses two processes for producing a hot rolled steel sheet having a structure comprising a retained austenite phase and containing 0.10–0.35% C, 1.0–3.0% Si, 0.5–2.5% Mn, and one or more of Cr, Al, P, and Ni. In a first process, after hot rolling is performed with a finish rolling end temperature below 950° C., the hot rolled steel sheet is cooled to a temperature between 600° C. and 800° C. at a rate of 1°–200° C./sec, then slowly cooled to a temperature immediately above the pearlite transformation temperature at a rate of 30° C./sec or lower, and further cooled to a coiling temperature between 300° C. and 500° C. at such a rate that pearlite transformation can be inhibited. In a second process, hot rolling is performed at a high reduction rate of at least 80% with a finish rolling end temperature below 850° C. The hot rolled steel sheet is then directly cooled to a coiling temperature between 300° C. and 500° C. at such a rate that pearlite transformation can be inhibited. Both processes provide a steel sheet having high strength and good ductility and press formability including good hole expandability. However, the hot rolled steel sheet is disadvantageous in that addition of a relatively large amount of Si is mandatory, which causes a eutectic reaction between $SiO_2$ and FeO significantly during heating in the hot rolling step, resulting in the uneven formation of low melting, high-Si scales on the steel surface. As a result, the resulting hot rolled steel sheet has an uneven surface after pickling for descaling, thereby impairing the surface quality significantly.

SUMMARY OF THE INVENTION

It is an object of this invention to provide a high tensile strength steel sheet suitable for use in forming, particularly press forming and flange forming, which has improved ductility and press formability, including improved hole expandability, as well as high strength and good weldability.

Another object of this invention is to provide such a high tensile strength steel sheet having a good surface quality.

A further object of this invention is to provide such a high tensile strength steel sheet having a level of strength which can be controlled without a substantial change in carbon content.

A further object of this invention is to provide such a high tensile strength steel sheet having good corrosion resistance and surface coating characteristics.

A further object of this invention is to provide a process for producing such a high tensile strength steel sheet by hot or cold rolling in a stable manner.

These objects can be accomplished by a high tensile strength steel sheet having improved ductility and hole expandability which consists essentially, on a weight basis, of:

C: 0.05–0.3%, Si: 2.5% or less, Mn: 0.05–4%,

Al: greater than 0.10% and not greater than 2.0% wherein $$0.5 \leqq Si(\%)+Al(\%) \leqq 3.0,$$

optionally one or more of Cu, Ni, Cr, Ca, Zr, rare earth metals (REM), Nb, Ti, and V in the following amounts:

Cu: 0.1–2.0% and $Cu(\%) \geqq Si(\%)/5$,

Ni: up to 1.0%, $Ni(\%) \geqq Cu(\%)/3$, and $Mn(\%)+Ni(\%) \geqq 0.5$,

Cr: 0.5–5.0% and $7.0 \geqq Mn(\%)+Cr(\%) \geqq 1.0$

Ca: 0.0002–0.01%, Zr: 0.01–0.10%, REM: 0.01–0.10%,

Nb: 0.005–0.10%, Ti: 0.005–0.10%, V: 0.005–0.20%, and a balance of Fe and inevitable impurities with N being limited to 0.01% or less, the steel sheet having a structure which comprises at least 5% by volume of a retained austenite phase.

The steel sheet may be either hot rolled or cold rolled. Among the optional elements described above, Cu and Ni are suitable for addition to a cold rolled steel sheet, while the other optional elements are suitable for addition to a hot rolled steel sheet.

A hot rolled, high tensile strength steel sheet according to this invention can be produced by a process which comprises the steps of heating a steel having a chemical composition as described above at a temperature above the $Ac_3$ point, subjecting the heated steel to hot rolling with a finish rolling end temperature in the range of 780°–840° C., and cooling the hot rolled steel sheet at a rate of 10°–50° C./sec to a temperature in the range of 300°–450° C., at which temperature the sheet is then coiled.

Another process for producing the hot rolled, high tensile strength steel sheet comprises the steps of heating a steel having a chemical composition as described above at a temperature above the $Ac_3$ point, subjecting the heated steel to hot rolling with a finish rolling end temperature in the range of 780°–940° C., and cooling the hot rolled steel sheet by initially rapidly cooling at a rate of at least 10° C./sec to a temperature range of 600°–700° C., then air-cooling in that temperature range for 2–10 seconds, and finally rapidly cooling at a rate of at least 20° C./sec to a temperature in the range of 300°–450° C., at which temperature the sheet is then coiled.

A cold rolled, high tensile strength steel sheet according to this invention can be produced by a process which comprises the steps of hot rolling a steel having a chemical composition as described above followed by cooling and coiling at a temperature in the range of 300°–720° C., subjecting the hot-rolled steel sheet, after descaling, to cold rolling with a reduction of 30–80%, heating the cold rolled steel sheet at a temperature in the range of above the $Ac_1$ point and below the $Ac_3$ point in a subsequent continuous annealing or continuous galvanizing stage, and finally cooling the heated steel sheet in such a manner that it is either kept for at least 30 seconds in a temperature range of 550° C. or slowly cooled at a rate of 400° C./min or less in that temperature range in the course of cooling.

When the steel contains Cu in an amount as defined above and is slowly cooled in the course of the final cooling, it is preferable that the cooling rate be 100° C./min or less.

DETAILED DESCRIPTION OF THE INVENTION

Figure 1:
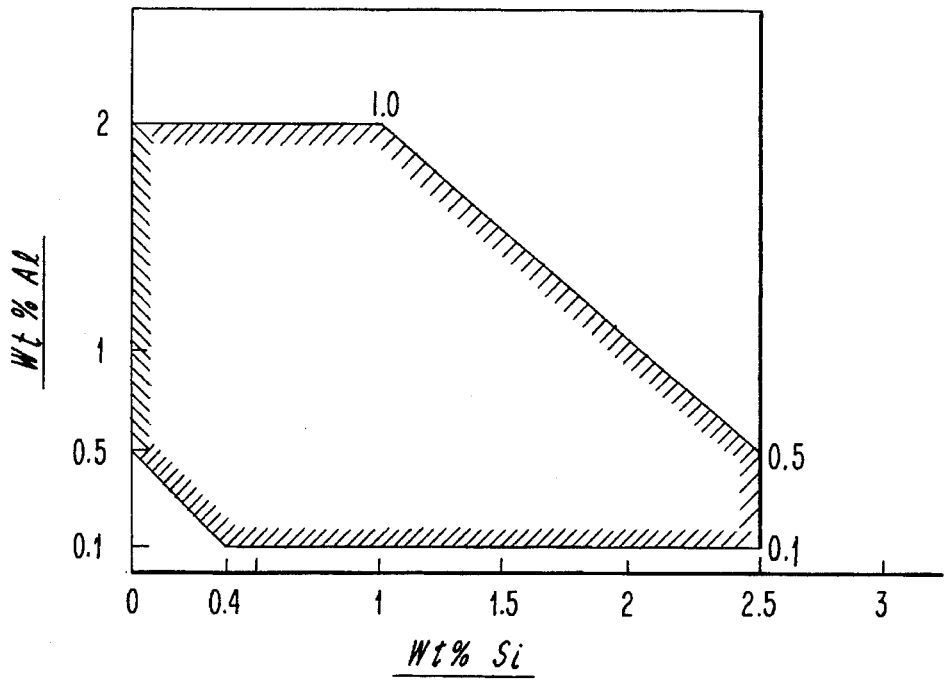
FIG. 1 shows the ranges of Si and Al contents of a steel sheet according to this invention.

The experimental data given in Table 1 below were obtained in our investigations and they show the effects of Al and Si contents of hot rolled steel sheets having a retained austenite phase on the volume fraction of retained austenite phase, tensile properties, and hole expandability. The tensile properties and hole expansion limits in Table 1 were determined in the same manner as employed in the examples set forth hereinafter except that the test pieces used for the determination of hole expansion limits had a thickness of 2.6 mm.

TABLE 1

| Steel Composition (%) | | | | γ* | TS | El | HEL |
|---|---|---|---|---|---|---|---|
| C | Si | Mn | Al | (vol %) | (MPa) | (%) | (%) |
| 0.16 | 1.45 | 1.65 | 0.04 | 15.1 | 796 | 33.3 | 45.1 |
| 0.15 | 0.35 | 1.56 | 1.42 | 17.8 | 789 | 41.8 | 98.6 |
| 0.16 | 0.55 | 1.S4 | 1.53 | 17.1 | 800 | 42.4 | 97.3 |
| 0.15 | 0.74 | 1.52 | 1.2S | 17.9 | 810 | 40.5 | 93.4 |
| 0.15 | 0.04 | 1.73 | 1.54 | 18.4 | 720 | 43.2 | 112.3 |
| 0.21 | 1.50 | 1.35 | 0.05 | 17.4 | 806 | 32.5 | 42.3 |
| 0.20 | 1.45 | 1.42 | 0.32 | 16.2 | 809 | 33.5 | 82.9 |
| 0.21 | 1.03 | 1.33 | 0.56 | 18.8 | 796 | 35.3 | 94.3 |
| 0.20 | 0.04 | 1.42 | 1.22 | 15.9 | 760 | 39.4 | 108.2 |
| 0.21 | 0.02 | 1.33 | 1.62 | 18.3 | 770 | 41.3 | 113.3 |

*γ: volume fraction of retained austenite

The following facts (A) to (C) are deduced from Table 1.

(A) Like Si, Al is effective for retaining austenite, and the volume fraction of retained austenite phase obtained by addition of Al is approximately equal to that obtained by addition of Si in the same amount.

In conventional high tensile strength steel sheets having a retained austenite phase, Si is usually added in a relatively large amount since addition of Si is known to be highly effective for the retention of austenite in a relatively low C content range which is desirable for weldability. On the other hand, in view of the fact that Al is a ferrite stabilizer, addition of Al has been considered to be disadvantageous in order to increase the volume fraction of retained austenite. However, it has been found that Al is as effective as Si for retaining austenite.

(B) Surprisingly, addition of Al in place of a part of Si results in a remarkable increase in hole expansion limit (HEL) along with an increase in elongation, although it accompanies a slight decrease in tensile strength. As a result, the tensile strength-elongation balance (TSxEl) of the resulting steel is comparable or superior to that of a conventional Al-free, Si-containing high tensile strength steel, while the tensile strength-hole expansion balance (TSxHEL) thereof is significantly greater than that of the conventional steel. It is assumed that the improved elongation is due to addition of Al which serves to accelerate the formation of polygonal ferrite and that the significantly improved hole expandability is due to uniform distribution of grains of disperse phase or phases (retained austenite or a mixture of retained austenite and bainite) in the polygonal ferrite matrix.

(C) Addition of Si and Al in combination makes it possible to control the strength level of a steel merely by varying the ratio of Si to Al content for a given total content of Si and Al. Therefore, the strength level can be controlled without a significant change in the C content and while maintaining the volume fraction of retained austenite phase at a constant level.

The addition of Al with a decreased amount of Si for ensuring the retention of austenite is also effective for minimizing the formation of the above-described low melting, high-Si scales during hot rolling, thereby ensuring that the final product has a good surface quality.

We also made similar experiments with respect to continuously annealed, cold rolled, high tensile strength steel sheets which contain about 0.15% C, 1.5% Mn, and different amounts of Al and Si to investigate the effects of Si and Al. It was confirmed that approximately the same results as described above are obtained in these experiments, too.

In the case of cold rolled steel sheets, an Al-containing steel sheet may have a total elongation which is lower than that of an equivalent Si-containing steel sheet. However, the value for local elongation of the former calculated by subtracting a uniform elongation from the total elongation is greater than that of the latter, and such a greater local elongation is responsible for the significantly improved hole expandability. The greater local elongation is considered to be attributable to the fact that the $Ar_3$ point of an Al-containing steel is higher than that of an Si-containing steel. As a result, the austenite phase retained in the former steel has an increased C concentration, which serves to stabilize the retained austenite phase. Therefore, an Al-containing steel is not susceptible to stress-induced transformation in a low stress region and such transformation occurs only after the stress has increased to cause a large deformation, thereby increasing the local elongation.

In the production of a hot rolled steel sheet having a retained austenite phase from a steel containing both Si and Al, it is possible to ensure the retention of austenite in an amount sufficient to improve the elongation by proper control of the conditions for cooling and coiling after hot rolling. Similarly, in the production of a cold rolled steel sheet having a retained austenite phase from such a steel by subjecting a hot rolled, coiled steel sheet to cold rolling and annealing, the retention of a sufficient amount of austenite can be ensured by proper control of the conditions for coiling after hot rolling and for cold rolling and subsequent annealing. As a result, a high tensile strength, hot or cold rolled steel sheet having improved elongation and hole expandability can be produced in a stable manner.

The reasons for defining the steel composition and production conditions as described above in a high tensile strength steel sheet according to this invention will be explained in detail below.

Carbon (C):

C is the most potent austenite stabilizer and becomes concentrated in an untransformed austenite phase as ferrite transformation proceeds in the course of cooling after hot rolling or annealing, thereby stabilizing the austenite phase. C also serves to strengthen the steel. These effects of C are not attained sufficiently with a C content of less than 0.5%. In the case of a cold rolled steel sheet, the presence of at least 1% C in an austenite phase is generally necessary to stabilize the austenite phase at room temperature. However, by proper selection of the cooling pattern after hot rolling or the heating cycle in annealing, sufficient stabilization of the austenite phase can be achieved with a C content of 0.05% or higher. Addition of C in excess of 0.3% causes a significant decrease in weldability and make the steel so hard that cold rolling becomes difficult. The C content is preferably in the range of 0.10–0.25% and more preferably in the range of 0.10–0.20%.

Silicon (Si):

Si is a ferrite stabilizer and is known to be quite effective for the retention of austenite during cooling after hot rolling since it serves to accelerate the formation of polygonal ferrite, facilitate the concentration of C into an untransformed austenite phase, and retard the precipitation of cementite. Similarly, in a cold rolled steel sheet, Si has an effect, during annealing in the ferrite austenite two phase and increasing the C concentration in the austenite phase which is in equilibrium with the ferrite phase. Furthermore, Si serves to strengthen the ferrite phase. For these reasons, a conventional high tensile strength steel sheet having a retained austenite phase has an Si content on the order of 1% or more.

However, in accordance with this invention, Al is added in order to contribute to stabilization of ferrite. Therefore, the lower limit of the Si content is not critical, and it is possible to lower the Si content to 0.1% or less. Addition of Si in excess of 2.5% not only results in the formation of coarse bainite grains or hard martensite, thereby deteriorating the hole expandability, but also causes high-Si scales inherent in Si-containing steels to form in an appreciable amount, thereby deteriorating the surface appearance and surface processability by alloyed galvanizing. Therefore, the Si content is limited to 2.5% or less and preferably 2.0% or less.

When the Si content is decreased to less than 1.0%, the formation of high-Si scales can be eliminated substantially completely and the surface appearance is appreciably improved. Consequently, the Si content is more preferably less than 1.0% and most preferably in the range of 0.2–0.9%.

Manganese (Mn):

Mn is an austenite stabilizer and serves to lower the Ms point of untransformed austenite, improve the hardenability, and suppress pearlite transformation of untransformed austenite. In addition, Mn has an effect of fixing S present in a steel to form MnS, thereby preventing hot shortness of the steel. These effects are ensured by addition of at least 0.05% Mn. An Mn content in excess of 4% makes the steel so hard as to decrease the ductility and also makes it difficult to form polygonal ferrite in a sufficient amount during cooling after hot rolling or annealing, thereby resulting in a failure of concentration of C into untransformed austenite to a degree sufficient to stabilize the austenite phase. Thus, the Mn content is in the range of 0.005–4%, preferably 0.5–2.5%, and more preferably 0.5–2.0%.

Aluminum (Al):

As described previously, Al is a ferrite stabilizer like Si and assists in retention of austenite during cooling after hot rolling by accelerating the formation of polygonal ferrite, facilitating the concentration of C into an untransformed austenite phase, and retarding the precipitation of cementite. Al has an additional effect of promoting the formation of uniform and fine polygonal ferrite grains and suppress the formation of coarse bainite grains which adversely affect the hole expandability. As a result, an Al-containing steel, when compared to a steel containing Si in the same amount, has approximately the same volume fraction of retained austenite, a slightly increased elongation, and a significantly improved hole expandability, thereby significantly facilitating press forming including flange forming and hole expansion.

In the production of a cold rolled steel sheet, during annealing in the two phase region after cold rolling, Al serves to increase the volume fraction of the ferrite phase and increase the C concentration in the equilibrating austenite phase. Since the effect of Al on stabilization of retained austenite phase in this way is higher than that of Si, addition of Al results in a significant improvement in local elongation of a cold rolled steel sheet, which leads to a significant improvement in the hole expandability thereof.

Unlike Si, addition of Al is advantageous in that it does not cause the formation of high-Si scales during hot rolling, thereby assuring that the resulting steel sheet has a good surface appearance.

These effects of Al can be attained sufficiently when Al is added in an amount of greater than 0.10% as soluble Al (all the Al contents herein being % Al as sol. Al). Addition of Al in excess of 2.0% increases the amount of inclusions in the steel, thereby adversely affecting the ductility and hole expandability. Therefore, the Al content is greater than 0.10% and not greater than 2.0% preferably in the range of 0.25–2.0%, and more preferably in the range of 0.50–1.5%.

Sum of Si and Al contents (Si+Al):

As the total amount of Si and Al, which are both ferrite stabilizers, is increased, the proportion of ferrite formed during cooling increases while that of austenite decreases, and the C concentration in the austenite phase increases, thereby enhancing the stability of that phase. Therefore, if the sum of Si and Al contents [abbreviated as (Si+Al)] is increased too much, the desirable high ductility developed by the stress induced transformation of a retained austenite phase will not be obtained sufficiently due to an excessive decrease in the proportion of austenite and excessive stabilization thereof. On the other hand, if (Si+Al) is excessively low, the effects of these elements on retention of austenite by stabilization of ferrite will not be attained appreciably. Therefore, (Si+Al) should be in the range of 0.5–3.0%, preferably 1.0–2.5%, and more preferably 1.5–2.5%.

FIG. 1 shows the ranges of Si and Al contents of the steel composition according to this invention.

Nitrogen (N):

N is present as an inevitable impurity in a steel according to this invention, and hence the steel preferably has a minimized N content. The maximum acceptable N content is 0.01% since a greater N content significantly increases the amount of Al consumed as AlN, thereby not only diminishing the above-described favorable effects of Al but also causing a prominent deterioration in ductility. Preferably, the N content is 0.005% or less.

Phosphorus (P):

P is another incidental impurity and adversely affects weldability and ductility. Preferably, P is limited to 0.1% or less, although it should be minimized as much as possible. In order to assure uniform distribution of polygonal ferrite grains, it is more preferable that the P content be 0.02% or less.

Sulfur (S):

S is also an incidental impurity, which adversely affects ductility and press formability by the formation of sulfide inclusions. Preferably, S is limited to 0.1% or less, although it should be minimized as much as possible. In order to further improve the press formability, it is more preferable that the S content be 0.01% or less.

The following elements are optional elements which may be added to a steel according to this invention if necessary.

Copper (Cu):

Cu may be added, particularly to a cold rolled steel sheet according to this invention, since it serves to facilitate the removal of high-Si scales formed in the hot rolling stage and improve the corrosion resistance when the cold rolled steel sheet is used as such without surface treatment or improve the wettability by molten zinc or the alloy forming ability when it is subjected to galvanizing or alloyed galvanizing in a continuous galvanizing line.

These effects cannot be attained sufficiently when the Cu content is either lower than 0.1% or lower than [Si(%)/5]. Addition of Cu in excess of 2.0% causes an excessive decrease in stacking fault energy of retained austenite for an unknown reason, thereby preventing development of the stress-induced transformation and decreasing the ductility extremely. Therefore, the Cu content is in the range of 0.1–2.0%, preferably 0.1–0.6%, and equal to or higher than [Si(%)/5], when Cu is added.

Nickel (Ni):

In a steel containing Cu in excess of 0.5%, surface defects called hairline cracks may be formed during heating prior to hot rolling due to the formation of a Cu-rich, low melting alloy phase along austenite grain boundaries. Ni serves to minimize the formation of these defects by increasing the melting point of the alloy phase. This effect of Ni is appreciable when the Ni content is over [Cu(%)/3].

Accordingly, when Cu is added in an amount of greater than 0.5%, Ni is preferably added in such an amount that the Ni content is equal to or higher than [Cu(%)/3]. The upper limit of the Ni content is 1.0%, primarily from the standpoint of economy. Since Ni is an austenite stabilizer like Mn, it is preferable that the sum of the Mn and Ni contents be over 0.5%.

Thus, the Ni content, when added, is not greater than 1.0% and preferably not greater than 0.5%, and it preferably satisfies: Ni(%)≧Cu(%)/3 when Cu(%)>0.5, and [Mn(%)+Ni(%)]≧0.5.

Chromium (Cr):

Cr is another austenite stabilizer, and it may be added for stabilization of austenite and improvement in corrosion resistance. For this purpose, addition of at least 0.5% Cr is effective. On the contrary, addition of Cr in excess of 5.0% causes excessive stabilization of ferrite, thereby making the equilibrating austenite phase unstable. At the same time, pickling of the resulting steel sheet becomes extremely difficult. Therefore, the content of Cr, when added, is in the range of 0.5–5.0% and preferably 0.6–1.6%.

The Cr content should be adjusted in terms of the total amount of Mn and Cr since both are austenite stabilizers. The sum of Mn and Cr contents is preferably between 1.0% and 7.0% and more preferably between 1.0% and 3.0% for the reasons described for Mn.

Calcium (Ca), zirconium (Zr), and rare earth metals (REM):

Since these elements have an effect of controlling the shape of inclusions in a steel so as to improve the cold workability including press formability thereof, one or more of these elements may be added. The effect is not appreciable when the content is less than 0.0002% for Ca or less than 0.01% for Zr and REM. Addition of Ca in excess of 0.01% or Zr or REM in excess of 0.10% causes the amount of inclusions to increase so much that the press formability is deteriorated. Therefore, when added, the Ca content is between 0.0002% and 0.01% and the Zr content and the REM content are both between 0.01% and 0.10%. Preferably, the upper limit is 0.005% for Ca and 0.05% for Zr and REM.

Niobium (Nb), titanium (Ti), and vanadium (V):

Each of these elements precipitates as a carbo-nitride in a ferrite matrix, thereby contributing to a further increase in tensile strength of the steel sheet. This effect cannot be attained sufficiently when the content is less than 0.005% for each element, and becomes saturated when the content exceeds 0.10% for Ni and Ti or 0.20% for V. Therefore, when these elements are added, the Nb content and Ti content are both between 0.005% and 0.10% and the V content is between 0.005% and 0.20%. Preferably, the upper limit is 0.05% for Nb and Ti or 0.10% for V.

Volume fraction of retained austenite:

The ductility of the hot or cold rolled steel sheet according to this invention depends on the volume fraction of retained austenite phase present therein. In order to assure than the steel sheet has improved ductility caused by stress-induced transformation of austenite, the steel sheet should contain at least 5%, preferably at least 10%, and more preferably at least 15% by volume of a retained austenite phase.

The high tensile strength steel sheet in accordance with this invention can be produced from a steel having a chemical composition as described above by hot rolling or cold rolling. When the steel sheet is hot rolled one, the conditions for heating before hot rolling and for cooling and coiling after hot rolling are controlled. When it is a cold rolled steel sheet, the conditions for coiling after hot rolling and for cold rolling and subsequent annealing are controlled.

The starting steel, which is in the form of a slab to be hot rolled, can be obtained by either continuous casting or ingot making and subsequent slabbing from a molten steel prepared in a converter, electric furnace, or open-hearth furnace. In the case of ingot making, the steel may be a rimmed steel, capped steel, semi-killed steel, or killed steel. The slab may be either a hot slab as cast or a cold slab stored at room temperature.

Conditions for producing a hot rolled steel sheet:

A hot rolled steel sheet according to this invention can be produced by a process which comprises heating a starting steel having a chemical composition as described above at a temperature above the $Ac_3$ point of the steel, subjecting the heated steel to hot rolling with a finish rolling end temperature in the range of 780°–840° C., and rapidly cooling the hot rolled steel at a rate of 10°–50° C./sec to a temperature in the range of 300°–450° C. and preferably 350–450° C., at which temperature the sheet is coiled.

Generally, the hot rolled steel sheet has a structure comprising at least 5% by volume of a retained austenite phase in a matrix comprised predominantly of polygonal ferrite. In the case of a steel containing 0.5–5% Cr, the structure may further comprise a substantial amount of bainite, like a cold rolled steel sheet described hereinafter.

By heating the starting steel at a temperature above the $Ac_3$ point and preferably above 1100° C. prior to hot rolling, it is possible to completely dissolve the added alloying elements in the resulting austenite phase to form a solid solution.

Hot rolling is completed by finish rolling ending at a temperature in the range of 780°–840° C., whereby the austenite phase are refined into fine grains while undergoing work hardening, which makes it possible to accelerate the formation of polygonal ferrite in a subsequent cooling step. As a result, a substantial amount of polygonal ferrite can be formed during the subsequent rapid cooling at a rate of 10°–50° /sec and preferably 20°–40° C./sec while leaving an adequate amount of austenite untransformed. If the finish rolling end temperature is below 780° C., premature formation of ferrite may occur during hot rolling to form work-hardened ferrite, thereby deteriorating the press formability of the resulting hot rolled steel sheet. On the other hand, if the finish rolling end temperature is above 840° C., work hardening of the austenite phase may not occur sufficiently and hence polygonal ferrite cannot be formed in the rapid cooling step in an amount sufficient to enable a substantial amount of the austenite to remain untransformed.

If the cooling rate after hot rolling is lower than 10° C./sec or the coiling temperature is above 450° C., pearlite may form during cooling, and austenite will not be retained in a substantial amount. A cooling rate higher that 50° C./sec may not cause the formation of polygonal ferrite in an amount sufficient to enable the retention of a substantial amount of austenite. Coiling at a temperature below 300° C. accelerates the formation of martensite, thereby deteriorating the ductility and hole expandability of the steel.

Alternatively, a hot rolled steel sheet according to the present invention can be produced by a second process which comprises heating a steel having a chemical composition as described above at a temperature above the $Ac_3$ point and preferably above 1100° C., subjecting the heated steel to hot rolling with a finish rolling end temperature in the range of 780°–940° C., and cooling the hot rolled steel sheet by initial rapid cooling at a rate of at least 10° C./sec to a temperature range of 600°–700° C. and subsequent air-cooling in that temperature range for 2–10 seconds followed by final rapid cooling at a rate of at least 20° C./sec to a temperature in the range of 300°–450° C., at which temperature the sheet is coiled.

After hot rolling is finished with a finish rolling end temperature in the range of 780°–940° C. and preferably 840°–940° C. so as to refine the resulting austenite phase into fine grains, the hot rolled steel sheet is rapidly cooled to a temperature range of 600°–700° C. and then air-cooled in that temperature range for 2–10 seconds, whereby the formation of polygonal ferrite and concentration of C into untransformed austenite are both accelerated to a degree sufficient to enable a substantial amount of austenite to remain untransformed.

If the air cooling temperature range extends below 600° C. or the duration of air cooling is longer than 10 seconds, pearlite may form during cooling, and austenite will not be retained in a substantial amount. On the other hand, if the air cooling temperature range extends above 700° C. or the duration of air cooling is shorter than 2 seconds, polygonal ferrite may not be formed in an amount sufficient to enable a substantial amount of austenite to remain untransformed.

The cooling step after hot rolling is performed initially by rapid cooling at a rate of at least 10° C./sec and preferably at least 30° C./sec in order to keep a period of time in the range of 2–10 seconds for air cooling on a hot run table having a limited length. After the air cooling, the steel sheet is again rapidly cooled at a rate of at least 20° C./sec and preferably at least 30° C./sec before coiling so as to prevent the formation of pearlite. The coiling temperature is in the range of 300°–450° C. and preferably 350°–450° C. for reason given above.

Conditions for producing a cold rolled steel sheet:

A cold rolled steel sheet according to this invention can be produced by a process which comprises hot rolling a steel having a chemical composition as described above followed by cooling and coiling at a temperature in the range of 300°–720° C., subjecting the hot-rolled steel sheet, after descaling, to cold rolling with a reduction of 30–80%, heating the cold rolled steel sheet at a temperature in the range of above the $Ac_1$ point and below the $Ac_3$ point in a subsequent continuous annealing stage, and finally cooling the heated steel sheet in such a manner that it is either kept for at least 30 seconds in a temperature range of 550° C. down to 350° C. or slowly cooled at a rate of 400° C./min or less in that temperature range in the course of cooling.

Coiling temperature after hot rolling:

In a steel having a chemical composition as described above, coiling at a low temperature after hot rolling causes the steel to harden to such a degree that subsequent pickling for descaling or cold rolling becomes difficult. On the contrary, coiling at a high temperature results in coarsening of the resulting cementite, thereby softening the steel and facilitating pickling and cold rolling. However, at the same time, the isothermal heating in the annealing step requires a long period of time to redissolve the coarse cementite to form a solid solution, thereby making it difficult to retain a substantial amount of austenite. In order to avoid these disadvantages, the hot rolled steel sheet is coiled at a temperature in the range of 300°–720° C. Preferably, the coiling temperature is in the range of 500°–650° C. since it is desirable to facilitate pickling and cold rolling.

Reduction rate for cold rolling:

After the hot rolled sheet is cooled, coiled, and descaled, it is cold rolled with a reduction of 30–80% and preferably 50–75%. At reduction rate of lower than 30% does not cause recrystallization completely in the subsequent annealing step, thereby deteriorating the ductility of the steel. At a reduction rate of higher than 80%, an excessive load is undesirably applied to the mill.

Conditions for continuous annealing:

In continuous annealing of a cold rolled steel sheet, the steel sheet is initially subjected to isothermal heating at a temperature above the $Ac_1$ point and below the $Ac_3$ point in order to form a mixed ferritic and austenitic two-phase structure. The isothermal heating is preferably performed in the temperature range of 800°–850° C. Heating at a lower temperature may require a long period of time to completely redissolve the cementite, while heating at a higher temperature increases the volume fraction of austenite so much that the C concentration of the austenite phase decreases.

The cooling rate after the isothermal heating is not critical except in the temperature range of 550° C. down to 350° C. for overaging, However, it is desirable that initial cooling immediately after the isothermal heating down to 700° C. be slow cooling at a rate of 10° C./sec or less in order to grow the ferrite grains and increase the C concentration of the austenite phase sufficiently. It is also desirable that the subsequent cooling below 700° C. until the steel sheet enters an overaging zone be rapid cooling at a rate of 50° C./sec or greater in order to minimize pearlite transformation of austenite.

In the overaging zone, the steel sheet is either kept in a temperature range of 550° C. down to 350° C. for at least 30 seconds and preferably at least 2 minutes, or slowly cooled in that temperature range at a rate of 400° C./min or less, thereby transforming a part of the austenite phase into bainite while accelerating the concentration of C into the remaining austenite. When the overaging temperature is higher than 550° C., bainite transformation does not occur. Overaging at a temperature below 350° C. forms lower bainite, which does not cause the concentration of C into austenite sufficiently.

When the steel contains Cu in an amount of at least 0.5% and the overaging is performed by slow cooling, it is preferable to employ a slower cooking rate of 100° C./min or less in order to prevent the precipitation of epsilon ($\epsilon$) -Cu, which inhibits bainite transformation.

The cooling rate after overaging may be either rapid or slow cooling.

The above described annealing amy be performed, in place of a continuous annealing line, in a continuous galvanizing line having a constant temperature zone with a length corresponding to 30 seconds or longer. In this case, subsequent alloying treatment, if performed, does not have a significant effect on the steel structure as long as the heating temperature for alloying is below 600° C., since the heating is carried out after bainite transformation.

The resulting cold rolled steel sheet after annealing has a mixed structure composed of ferrite, bainite, and retained austenite.

The resulting hot or cold rolled, high tensile strength steel sheet produced by a process according to the present invention has good weldability required for high strength parts or structural materials due to the relatively low C content in the range of 0.05–0.30%. In addition, it has a retained austenite phase in an amount of at least 5% by volume, which is sufficient to improve the ductility by the TRIP phenomenon. Furthermore, addition of Al along with Si enables the steel sheet to be improved sufficiently in local ductility and hole expandability, which are relatively poor in conventional Si-containing, austenite-retained steel sheets.

As a result, the steel sheet has a good tensile strength-elongation balance (TSxE1) on the order of 24,500 (in MPa-%) or greater except for Cu-containing steels having a TSxEl balance on the order of 20,000 or greater. In addition, it has a significantly improved tensile strength-hole expandability balance (TSxHEL), which is as high as at least 65,000 (MPa-%) for Cr-free hot rolled steel sheets, for example. Moreover, by addition of Al, these favorable properties can be attained even with a relatively low Si content of less than 1.0%, thereby ensuring that the resulting steel sheet has a good surface quality which is free from surface unevenness caused by the formation of high-Si scales.

The hot or cold rolled steel sheet according to the present invention may be surface-treated by galvanizing, alloyed galvanizing, electroplating, chemical conversion treatment, thin organic coating, or the like or a combination of these, thereby making it possible to obtain a surface treated, high tensile strength steel sheet having improved ductility and hole expandability.

The following examples are presented to further illustrate the present invention. These examples are to be considered in all respects as illustrative and not restrictive.

EXAMPLE 1

Hot rolled steel sheets having a thickness of 2.3 mm were produced by subjecting slabs having chemical compositions given in Table 2 to heating, hot rolling, and controlled cooling followed by coiling under the conditions given in Tables 3 and 4. The slabs were 60 mm thick and were made by hot forging of steel ingots prepared by melting in a 50 kg vacuum melting furnace.

The tensile properties of each hot rolled steel sheet were determined with JIS No. 5 test pieces taken from the steel sheet.

The hole expandability of the hot rolled steel sheet was measured by a hole expansion test. In this test, 120 mm-square test pieces (blanks) were prepared and punched at the center to make a hole 14 mm in diameter with a clearance of 15% , and the hole was expanded with a conical punch and a die. The diameter of the expanded hole was determined when a crack penetrating the thickness of the test piece sheet (through-crack) was first observed around the hole. The hole expandability was evaluated in terms of the hole expansion limit (HEL) calculated as follows:

$$HEL(\%)=(HD_1-HD_0)/HD_0\times 100$$

where $HD_0$: diameter of initial hole before expansion (=14 mm), $HD_1$: diameter of expanded hole when the first through-crack was observed.

The volume fraction of retained austenite of each hot rolled steel sheet was also determined using a test piece for X-ray irradiation taken from a center portion of the steel sheet by measuring the intensity of reflected X-rays.

The test results are also shown in Tables 3 and 4.

TABLE 2-1

| Steel No. THIS INVENTION | Chemical Composition (wt %) (Balance: Fe + Impurities) | | | | | | | | | | |
|---|---|---|---|---|---|---|---|---|---|---|---|
| | C | Si | Mn | Al | Ca | Zr | REM[1)] | Nb | Ti | V | Si + Al |
| 1 | 0.20 | 0.02 | 1.61 | 1.82 | — | — | — | — | — | — | 1.84 |
| 2 | 0.24 | 0.05 | 0.90 | 1.67 | — | — | — | — | — | — | 1.72 |
| 3 | 0.23 | 0.01 | 1.94 | 1.01 | — | — | — | — | — | — | 1.02 |
| 4 | 0.13 | 0.03 | 1.48 | 1.26 | — | — | — | — | — | — | 1.29 |
| 5 | 0.15 | 0.01 | 1.42 | 1.34 | 0.0012 | — | — | — | — | — | 1.35 |
| 6 | 0.19 | 0.02 | 1.74 | 1.88 | — | — | — | 0.032 | — | — | 1.90 |
| 7 | 0.21 | 0.01 | 1.66 | 1.81 | — | 0.023 | — | — | — | 0.041 | 1.82 |
| 8 | 0.18 | 0.02 | 1.42 | 1.32 | — | — | — | 0.023 | 0.015 | — | 1.34 |
| 9 | 0.11 | 0.01 | 1.68 | 1.65 | 0.0008 | 0.012 | — | — | — | — | 1.66 |
| 10 | 0.23 | 0.02 | 1.53 | 1.83 | — | 0.033 | — | — | — | — | 1.85 |
| 11 | 0.15 | 0.03 | 1.62 | 1.70 | — | — | — | — | 0.022 | — | 1.73 |
| 12 | 0.13 | 0.05 | 1.90 | 1.63 | — | — | — | — | — | 0.071 | 1.68 |
| 13 | 0.18 | 0.35 | 1.60 | 1.42 | — | — | — | — | — | — | 1.77 |
| 14 | 0.08 | 0.53 | 2.25 | 0.96 | — | — | — | — | — | — | 1.49 |
| 15 | 0.23 | 0.36 | 1.34 | 1.55 | — | — | — | — | — | — | 1.91 |
| 16 | 0.16 | 0.12 | 1.52 | 1.22 | — | — | — | — | — | — | 1.32 |
| 17 | 0.09 | 0.27 | 2.34 | 1.37 | 0.0025 | — | — | — | — | — | 1.64 |
| 18 | 0.15 | 0.55 | 1.73 | 1.73 | — | — | 0.022 | — | — | — | 2.28 |
| 19 | 0.20 | 0.25 | 1.44 | 1.40 | — | — | — | — | 0.018 | — | 1.65 |
| 20 | 0.22 | 0.66 | 1.20 | 0.89 | — | 0.027 | — | — | — | 0.024 | 1.55 |
| 21 | 0.18 | 0.53 | 1.43 | 1.36 | — | — | — | 0.017 | 0.000 | — | 1.89 |
| 22 | 0.13 | 0.91 | 1.51 | 1.63 | 0.0032 | — | — | 0.012 | — | — | 2.54 |
| 23 | 0.17 | 0.33 | 1.33 | 1.26 | — | 0.034 | — | — | — | — | 1.59 |
| 24 | 0.14 | 0.35 | 1.25 | 1.47 | — | — | — | 0.041 | — | — | 1.82 |
| 25 | 0.15 | 0.41 | 1.36 | 1.42 | — | — | — | — | — | 0.031 | 1.83 |
| 26 | 0.23 | 0.36 | 1.82 | 0.65 | — | — | — | — | — | — | 1.01 |
| 27 | 0.19 | 0.62 | 1.54 | 0.43 | — | — | — | — | — | — | 1.05 |
| 28 | 0.22 | 0.55 | 1.45 | 0.72 | — | — | — | — | — | — | 1.27 |

[1)]REM: Mish metal

TABLE 2-2

| Steel No. | Chemical Composition (wt %) (Balance: Fe + Impurities) C | Si | Mn | Al | Ca | Zr | REM[1)] | Nb | Ti | V | Si + Al |
|---|---|---|---|---|---|---|---|---|---|---|---|
| THIS INVENTION | | | | | | | | | | | |
| 29 | 0.18 | 1.12 | 1.63 | 0.32 | — | — | — | — | — | — | 1.44 |
| 30 | 0.07 | 1.53 | 2.28 | 0.94 | — | — | — | — | — | — | 2.47 |
| 31 | 0.20 | 2.26 | 0.87 | 0.18 | — | — | — | — | — | — | 2.44 |
| 32 | 0.23 | 1.32 | 1.54 | 0.54 | — | — | | — | — | — | 1.86 |
| 33 | 0.21 | 1.82 | 1.32 | 0.26 | — | — | — | — | — | — | 2.08 |
| 34 | 0.09 | 1.27 | 2.43 | 0.33 | 0.0023 | — | | — | — | — | 1.60 |
| 35 | 0.16 | 1.03 | 1.37 | 0.71 | — | — | 0.041 | — | — | — | 1.74 |
| 36 | 0.19 | 1.24 | 1.43 | 0.48 | — | — | — | — | 0.032 | | 1.72 |
| 37 | 0.22 | 1.31 | 1.25 | 0.87 | — | 0.031 | | — | — | 0.031 | 2.18 |
| 38 | 0.18 | 1.52 | 1.45 | 0.32 | — | — | — | 0.022 | 0.024 | — | 1.84 |
| 39 | 0.14 | 1.93 | 1.60 | 0.68 | 0.0012 | — | — | 0.012 | — | — | 2.61 |
| 40 | 0.15 | 1.35 | 1.25 | 0.55 | — | 0.025 | — | — | — | — | 1.90 |
| 41 | 0.16 | 1.42 | 1.30 | 1.53 | — | — | | 0.051 | — | — | 1.95 |
| 42 | 0.15 | 1.33 | 1.34 | 0.61 | — | — | — | — | — | 0.050 | 1.94 |
| 43 | 0.18 | 1.52 | 1.20 | 1.46 | — | — | — | — | | — | 2.98 |
| COMPARATIVE | | | | | | | | | | | |
| A | *0.34 | 0.01 | 1.75 | 1.54 | — | — | — | — | — | — | 1.55 |
| B | *0.02 | 0.01 | 1.80 | 1.43 | — | — | — | — | — | — | 1.44 |
| C | 0.22 | 1.64 | 1.59 | *0.04 | | — | — | — | — | — | 1.68 |
| D | *0.03 | 0.02 | 1.40 | 1.18 | — | — | — | — | — | — | 1.20 |
| E | 0.19 | 0.82 | 1.13 | *2.94 | — | — | — | — | — | — | *3.76 |
| F | *0.33 | 1.52 | 1.51 | 0.55 | — | — | — | — | — | — | 2.07 |
| G | 0.22 | 1.67 | 1.34 | *0.02 | — | — | | — | — | — | 1.69 |
| H | *0.02 | 0.77 | 1.40 | 0.15 | — | — | — | — | — | — | 0.92 |
| I | 0.20 | *2.82 | 0.97 | *0.04 | — | — | | — | — | — | 2.86 |
| J | 0.18 | 0.25 | 1.30 | 0.15 | — | — | — | — | — | — | *0.04 |

[1)]REM: Mish metal; *outside the range defined herein.

TABLE 3-1

| Run No. THIS INVENTION | Steel No. | Heating Temp. (°C.) | Finish Rolling End Temp (°C.) | Cooling Rate (°C./s) | Coiling Temp. (°C.) | γ[1)] (vol %) | Tensile Properties[2)] YS (MPa) | TS (MPa) | El (%) | TS × El | HEL[3)] (%) | TS × HEL |
|---|---|---|---|---|---|---|---|---|---|---|---|---|
| 1 | 1 | 1200 | 780 | 10 | 400 | 25 | 581 | 767 | 41.0 | 31447 | 109 | 83603 |
| 2 | | | 820 | 45 | 350 | 18 | 561 | 776 | 38.5 | 29876 | 116 | 90016 |
| 3 | 2 | | 800 | 15 | 440 | 23 | 540 | 711 | 44.9 | 31924 | 107 | 76077 |
| 4 | 3 | 1050 | | | 400 | 26 | 641 | 859 | 34.6 | 29721 | 102 | 87618 |
| 5 | 4 | | | | | 12 | 508 | 611 | 43.2 | 26395 | 132 | 80652 |
| 6 | 5 | | 840 | 20 | | 21 | 551 | 691 | 38.8 | 26811 | 105 | 72555 |
| 7 | 6 | 1200 | | | 380 | 22 | 576 | 759 | 33.8 | 25654 | 110 | 83490 |
| 8 | 7 | | 800 | 45 | | 21 | 533 | 711 | 36.6 | 26023 | 104 | 73944 |
| 9 | 8 | | | 15 | | 19 | 544 | 687 | 35.5 | 24389 | 114 | 78318 |
| 10 | 9 | | | | | 16 | 554 | 717 | 38.0 | 27246 | 104 | 74568 |
| 11 | 10 | | | | | 23 | 532 | 741 | 40.0 | 29640 | 112 | 82992 |
| 12 | 11 | | | | | 17 | 610 | 797 | 37.3 | 29728 | 101 | 90497 |
| 13 | 12 | | | | | 20 | 604 | 776 | 36.4 | 28246 | 106 | 82256 |
| 14 | 13 | | 780 | 10 | 400 | 24 | 519 | 798 | 39.5 | 31512 | 97 | 77406 |
| 15 | | | 820 | 45 | 320 | 19 | 514 | 809 | 41.0 | 33169 | 96 | 77664 |
| 16 | 14 | | | 25 | 400 | 20 | 525 | 752 | 41.7 | 31358 | 108 | 81216 |
| 17 | 15 | 1050 | 800 | 15 | | 28 | 515 | 826 | 37.4 | 30892 | 100 | 82600 |
| 18 | 16 | | | | | 20 | 492 | 797 | 42.8 | 34117 | 98 | 78106 |
| 19 | 17 | | 840 | 30 | | 16 | 497 | 742 | 44.8 | 33242 | 105 | 77910 |
| 20 | 18 | | | | | 22 | 513 | 769 | 39.5 | 30376 | 109 | 83821 |
| 21 | 19 | 1200 | | | 380 | 18 | 520 | 812 | 38.2 | 31018 | 93 | 75516 |
| 22 | 20 | | 800 | 45 | | 19 | 537 | 836 | 38.3 | 32019 | 97 | 91092 |
| 23 | 21 | | | 35 | | 21 | 504 | 816 | 36.6 | 30029 | 101 | 82416 |
| 24 | 22 | | | | | 17 | 499 | 781 | 43.0 | 33583 | 106 | 82786 |
| 25 | 23 | | | 15 | | 20 | 519 | 812 | 39.0 | 31668 | 100 | 81200 |
| 26 | 24 | | | | | 21 | 540 | 813 | 40.1 | 32601 | 96 | 78048 |
| 27 | 25 | | | | | 16 | 516 | 800 | 38.8 | 31040 | 103 | 82400 |
| 28 | 26 | | 780 | 10 | 400 | 18 | 519 | 806 | 38.4 | 30950 | 110 | 88660 |
| 29 | 27 | | 820 | 45 | 320 | 19 | 514 | 780 | 39.7 | 30966 | 93 | 72540 |

TABLE 3-1-continued

| Run No. THIS INVENTION | Steel No. | Heating Temp. (°C.) | Finish Rolling End Temp (°C.) | Cooling Rate (°C./s) | Coiling Temp. (°C.) | γ[1] (vol %) | Tensile Properties[2] YS (MPa) | TS | El (%) | TS × El | HEL[3] (%) | TS × HEL |
|---|---|---|---|---|---|---|---|---|---|---|---|---|
| 30 | 28 | | 800 | 25 | 400 | 20 | 525 | 801 | 37.6 | 30118 | 102 | 81702 |
| 31 | 29 | | 780 | 10 | 400 | 23 | 513 | 808 | 37.5 | 30300 | 89 | 71912 |
| 32 | | | 820 | 45 | 320 | 22 | 503 | 818 | 35.4 | 28957 | 94 | 76892 |

[1]γ: Volume fraction of retained austenite.
[2]YS: Yield Strength, TS: Tensile Strength, El: Elongation (Total)
[3]HEL: Hole Expansion Limit.

TABLE 3-2

| Run No. | Steel No. | Heating Temp. (°C.) | Finish Rolling End Temp (°C.) | Cooling Rate (°C./s) | Coiling Temp. (°C.) | γ[1] (vol %) | Tensile Properties[2] YS (MPa) | TS | El (%) | TS × El | HEL[3] (%) | TS × HEL |
|---|---|---|---|---|---|---|---|---|---|---|---|---|
| THIS INVENTION | | | | | | | | | | | | |
| 33 | 30 | 1200 | 800 | 25 | 400 | 17 | 543 | 774 | 37.1 | 28715 | 102 | 78948 |
| 34 | 31 | | | | 440 | 25 | 528 | 837 | 36.6 | 30670 | 82 | 68716 |
| 35 | 32 | 1050 | | 15 | 400 | 27 | 541 | 856 | 34.6 | 29618 | 93 | 79608 |
| 36 | 33 | | | | | 18 | 517 | 816 | 38.2 | 31171 | 84 | 685.44 |
| 37 | 34 | | 840 | 30 | | 14 | 531 | 760 | 37.4 | 28424 | 95 | 72200 |
| 38 | 35 | | | | | 21 | 522 | 793 | 35.5 | 28152 | 104 | 82472 |
| 39 | 36 | 1200 | | | 380 | 19 | 517 | 817 | 37.8 | 30882 | 88 | 71896 |
| 40 | 37 | | 800 | 45 | | 20 | 534 | 884 | 34.2 | 30233 | 84 | 74256 |
| 41 | 38 | | | 35 | | 19 | 515 | 834 | 33.3 | 27772 | 87 | 72558 |
| 42 | 39 | | | | | 16 | 535 | 820 | 37.0 | 30340 | 90 | 73800 |
| 43 | 40 | | | | | 16 | 503 | 790 | 37.8 | 29862 | 93 | 73470 |
| 44 | 41 | | | | | 18 | 519 | 845 | 36.4 | 30758 | 89 | 75205 |
| 45 | 42 | | | | | 17 | 529 | 825 | 37.5 | 30937 | 93 | 76725 |
| 46 | 43 | | | | 400 | 23 | 499 | 814 | 38.5 | 31339 | 86 | 70004 |
| COMPARATIVE | | | | | | | | | | | | |
| 47 | 1 | 1200 | 800 | 35 | *500 | 0 | 640 | 738 | 21.0 | 15498 | 59 | 43542 |
| 48 | | | *880 | | 420 | *3 | 646 | 807 | 19.5 | 15737 | 64 | 51648 |
| 49 | 2 | | *740 | *5 | 420 | *0 | 589 | 720 | 14.9 | 10728 | 44 | 31680 |
| 50 | *A | | 820 | 25 | | 15 | 646 | 826 | 27.5 | 22715 | 34 | 28084 |
| 51 | *C | | 800 | 15 | 400 | 24 | 590 | 801 | 28.9 | 23149 | 49 | 39249 |
| 52 | 13 | | | | *500 | *0 | 610 | 701 | 19.7 | 13810 | 49 | 34349 |
| 53 | | | *880 | 35 | 420 | *3 | 611 | 813 | 19.2 | 15610 | 47 | 38211 |
| 54 | 14 | | 820 | *65 | *200 | *0 | 499 | 787 | 22.2 | 17471 | 38 | 29906 |
| 55 | *E | | 800 | 45 | 400 | 22 | 600 | 803 | 27.7 | 22243 | 37 | 29711 |
| 56 | 29 | | | 15 | *500 | *0 | 631 | 709 | 20.1 | 14251 | 52 | 36868 |
| 57 | | | *880 | 35 | 420 | *3 | 643 | 834 | 18.4 | 15346 | 44 | 36696 |
| 58 | 30 | | 820 | *65 | | *0 | 626 | 828 | 17.2 | 14242 | 46 | 38088 |
| 59 | 31 | | *740 | *5 | | *0 | 574 | 711 | 15.5 | 11021 | 45 | 31995 |
| 60 | *F | | 820 | 25 | | 18 | 539 | 885 | 26.6 | 23541 | 33 | 29205 |
| 61 | *G | | | | | 16 | 523 | 837 | 27.2 | 22766 | 44 | 36828 |
| 62 | *I | | 800 | 45 | 400 | 22 | 409 | 821 | 29.7 | 24384 | 39 | 32019 |
| 63 | *J | | | 25 | | *0 | 614 | 668 | 22.0 | 14696 | 46 | 30728 |

[1]γ: Volume fraction of retained austenite.
[2]YS: Yield Strength, TS: Tensile Strength, El: Elongation (Total)
[3]HEL: Hole Expansion Limit.
*Outside the range defined herein.

TABLE 4-1

| Run No. THIS INVENTION | Steel No. | Heating Temp. (°C.) | Finish Rolling End Temp. (°C.) | Cooling Rate After H. R. (°C./s) | Air Cooling Temp. (°C.) | Air Cooling Duration (sec) | Cooling Rate After A. C. (°C./s) | Coiling Temp. (°C.) | γ[1] (vol %) | Tensile Prop.[2] YS (MPa) | TS | El (%) | HEL[3] (%) | TS × El | TS × HEL |
|---|---|---|---|---|---|---|---|---|---|---|---|---|---|---|---|
| 1 | 1 | 1200 | 780 | 20 | 680 | 5 | 50 | 400 | 24 | 578 | 777 | 40.2 | 102 | 31235 | 79254 |
| 2 | | | 900 | 55 | 600 | 3 | 25 | 350 | 17 | 551 | 758 | 38.5 | 110 | 29183 | 83380 |
| 3 | 2 | | 920 | 35 | 650 | 2 | 30 | 440 | 21 | 544 | 713 | 45.9 | 112 | 32727 | 70856 |

TABLE 4-1-continued

| Run No. | Steel No. | Heating Temp. (°C.) | Finish Rolling End Temp. (°C.) | Cooling Rate After H. R. (°C./s) | Air Cooling Temp. (°C.) | Air Cooling Duration (sec) | Cooling Rate After A. C. (°C./s) | Coiling Temp. (°C.) | γ[1] (vol %) | Tensile Prop.[2] YS (MPa) | TS (MPa) | El (%) | HEL[3] (%) | TS × El | TS × HEL |
|---|---|---|---|---|---|---|---|---|---|---|---|---|---|---|---|
| THIS INVENTION | | | | | | | | | | | | | | | |
| 4 | 3 | 1050 | | | 670 | 5 | | 400 | 25 | 637 | 855 | 33.6 | 105 | 28728 | 89775 |
| 5 | 4 | | | 15 | | | 45 | | 13 | 502 | 601 | 41.2 | 135 | 24761 | 81135 |
| 6 | 5 | | 860 | 25 | | | | | 23 | 544 | 687 | 39.8 | 101 | 27343 | 69387 |
| 7 | 6 | 1200 | | 40 | 650 | 3 | 25 | 380 | 20 | 568 | 749 | 32.7 | 117 | 24492 | 87633 |
| 8 | 7 | | 800 | | | | 90 | | 19 | 538 | 714 | 37.2 | 114 | 26561 | 81396 |
| 9 | 8 | | | 35 | | | 50 | | 15 | 539 | 699 | 34.8 | 105 | 24325 | 73395 |
| 10 | 9 | | | | | | | | 18 | 552 | 708 | 36.1 | 109 | 25559 | 77172 |
| 11 | 10 | | | | | | | | 24 | 525 | 733 | 42.0 | 117 | 30786 | 85761 |
| 12 | 11 | | | | | | | | 18 | 582 | 790 | 39.2 | 108 | 30968 | 85320 |
| 13 | 12 | | | | | | | | 22 | 593 | 774 | 38.0 | 109 | 29412 | 84366 |
| 14 | 13 | 1200 | 780 | 20 | 680 | 5 | 50 | 400 | 22 | 502 | 837 | 40.2 | 92 | 33647 | 77004 |
| 15 | | | 900 | 55 | 600 | 3 | 25 | 320 | 20 | 511 | 808 | 37.7 | 92 | 30462 | 74336 |
| 16 | 14 | | 920 | 90 | 700 | 10 | 20 | 400 | 18 | 490 | 742 | 43.7 | 112 | 32425 | 83104 |
| 17 | 15 | 1050 | | 35 | 670 | 5 | 30 | 400 | 24 | 535 | 877 | 39.3 | 95 | 34466 | 83315 |
| 18 | 16 | | | 15 | | | 45 | | 17 | 506 | 779 | 40.4 | 103 | 31472 | 80237 |
| 19 | 17 | | 860 | 25 | | | | | 25 | 522 | 754 | 40.9 | 111 | 30839 | 83094 |
| 20 | 18 | | | | | | 25 | | 21 | 493 | 752 | 40.8 | 110 | 30682 | 82720 |
| 21 | 19 | 1200 | | 40 | 650 | 3 | | 380 | 17 | 514 | 797 | 39.9 | 97 | 31800 | 77309 |
| 22 | 20 | | 800 | | | | 90 | | 23 | 502 | 784 | 40.8 | 104 | 31982 | 81556 |
| 23 | 21 | | | 35 | | | 50 | | 16 | 532 | 809 | 37.4 | 95 | 30257 | 76855 |
| 24 | 22 | | | | | | | | 19 | 496 | 727 | 43.3 | 104 | 31479 | 75608 |
| 25 | 23 | | | | | | | | 20 | 515 | 785 | 40.6 | 98 | 31871 | 76990 |
| 26 | 24 | | | | | | | | 17 | 524 | 765 | 40.0 | 93 | 30600 | 71145 |
| 27 | 25 | | | | | | | | 16 | 507 | 750 | 41.5 | 101 | 31125 | 75750 |
| 28 | 29 | 1200 | 780 | 20 | 680 | 5 | 50 | 400 | 22 | 500 | 836 | 38.3 | 82 | 32019 | 68552 |
| 29 | | | 900 | 55 | 600 | 3 | 25 | 320 | 19 | 522 | 804 | 36.5 | 90 | 29346 | 72360 |
| 30 | 30 | | 920 | 90 | 700 | 10 | 20 | 400 | 13 | 492 | 736 | 39.0 | 107 | 28704 | 78752 |
| 31 | 31 | | | 35 | 650 | 2 | 30 | 440 | 23 | 523 | 864 | 39.2 | 84 | 33869 | 72574 |
| 32 | 32 | 1050 | | | 670 | 5 | | 100 | 25 | 539 | 858 | 38.6 | 95 | 33119 | 81510 |
| 33 | 33 | | | 15 | | | 45 | | 16 | 505 | 794 | 35.4 | 83 | 28108 | 65902 |
| 34 | 34 | | 860 | 25 | | | | | 23 | 531 | 780 | 37.9 | 91 | 29562 | 70980 |
| 35 | 35 | | | | | | 25 | | 20 | 512 | 796 | 38.5 | 102 | 30646 | 81100 |

[1]γ: Volume fraction of retained austenite.
[2]YS: Yield Strength, TS: Tensile Strength, El: Elongation (Total)
[3]HEL: Hole Expansion Limit.
*Outside the range defined herein.

TABLE 4-2

| Run No. | Steel No. | Heating Temp. (°C.) | Finish Rolling End Temp. (°C.) | Cooling Rate After H. R. (°C./s) | Air Cooling Temp. (°C.) | Air Cooling Duration (sec) | Cooling Rate After A. C. (°C./s) | Coiling Temp. (°C.) | γ[1] (vol %) | Tensile Prop.[2] YS (MPa) | TS (MPa) | El (%) | HEL[3] (%) | TS × El | TS × HEL |
|---|---|---|---|---|---|---|---|---|---|---|---|---|---|---|---|
| T·H INVENTION | | | | | | | | | | | | | | | |
| 36 | 36 | 1200 | 860 | 40 | 650 | 3 | 25 | 380 | 18 | 510 | 817 | 35.7 | 92 | 29167 | 75164 |
| 37 | 37 | | | | | | 90 | | 24 | 509 | 806 | 38.2 | 98 | 30789 | 78988 |
| 38 | 38 | | | 35 | | | 50 | | 15 | 523 | 816 | 34.7 | 85 | 28315 | 69360 |
| 39 | 39 | | | | | | | | 18 | 526 | 747 | 35.2 | 100 | 26294 | 74700 |
| 40 | 40 | | | | | | | | 19 | 529 | 755 | 34.8 | 108 | 26274 | 81540 |
| 41 | 41 | | | | | | | | 20 | 552 | 776 | 37.0 | 105 | 28712 | 81480 |
| 42 | 42 | | | | | | | | 20 | 540 | 763 | 35.5 | 103 | 27087 | 78589 |
| COMPARATIVE | | | | | | | | | | | | | | | |
| 43 | 1 | 1200 | 900 | 15 | *730 | 5 | 25 | 400 | *2 | 660 | 787 | 18.0 | 49 | 14166 | 38563 |
| 44 | | | | 35 | *580 | 8 | 35 | 420 | *0 | 626 | 759 | 19.6 | 54 | 14876 | 40986 |
| 45 | | | 820 | | 650 | *12 | 65 | | *0 | 611 | 736 | 21.0 | 59 | 15456 | 43424 |
| 46 | | | | 50 | 670 | *1 | | | *4 | 642 | 766 | 22.5 | 44 | 17235 | 33704 |
| 47 | 2 | | 800 | *5 | 650 | 5 | 25 | *500 | *0 | 495 | 717 | 15.3 | 43 | 10970 | 30831 |
| 48 | *A | | 820 | 25 | 670 | | | 420 | 13 | 650 | 809 | 26.6 | 33 | 21519 | 26697 |
| 49 | *B | | | | | 4 | | | *0 | 347 | 417 | 29.6 | 92 | 12343 | 38364 |

TABLE 4-2-continued

| Run No. | Steel No. | Heating Temp. (°C.) | Finish Rolling End Temp. (°C.) | Cooling Rate After H. R. (°C./s) | Air Cooling Temp. (°C.) | Air Cooling Duration (sec) | Cooling Rate After A. C. (°C./s) | Coiling Temp. (°C.) | γ[1] (vol %) | Tensile Prop.[2] YS (MPa) | TS (MPa) | El (%) | HEL[3] (%) | TS × El | TS × HEL |
|---|---|---|---|---|---|---|---|---|---|---|---|---|---|---|---|
| 50 | *C | | 800 | 15 | 650 | 7 | 50 | 400 | 23 | 603 | 817 | 28.4 | 45 | 23203 | 36765 |
| 51 | 13 | | 900 | 15 | *730 | 5 | 25 | 400 | *2 | 522 | 827 | 17.9 | 44 | 14803 | 36388 |
| 52 | | | | 35 | *580 | 8 | 35 | 420 | *1 | 515 | 820 | 18.2 | 47 | 14924 | 38540 |
| 53 | | | 820 | | 650 | *12 | 65 | | *0 | 623 | 700 | 22.1 | 53 | 15470 | 37100 |
| 54 | | | 900 | 50 | 670 | *0 | | | *2 | 501 | 826 | 19.7 | 40 | 16272 | 33040 |
| 55 | 14 | | 820 | 35 | | 7 | *10 | | 83 | 624 | 686 | 25.2 | 56 | 17287 | 38416 |
| 56 | *D | | 820 | 25 | 670 | 4 | 25 | | *0 | 378 | 443 | 30.8 | 78 | 13644 | 34554 |
| 57 | *F | | 800 | 15 | 650 | 7 | 50 | 400 | 16 | 513 | 808 | 26.6 | 40 | 21493 | 32320 |
| 58 | 29 | | 900 | 15 | *730 | 5 | 25 | | *3 | 504 | 876 | 19.2 | 42 | 16819 | 36792 |
| 59 | | | | 35 | *580 | 8 | 35 | 420 | *1 | 521 | 853 | 18.7 | 50 | 15951 | 42650 |
| 60 | | | 820 | | 650 | *12 | 65 | | *0 | 630 | 719 | 21.0 | 58 | 15099 | 41702 |
| 61 | | | | 50 | 670 | *1 | | | *2 | 515 | 870 | 20.2 | 44 | 17574 | 38230 |
| 62 | 30 | | | 35 | 650 | 7 | *10 | | *2 | 619 | 699 | 24.3 | 55 | 16986 | 38445 |
| 63 | 31 | | 800 | *5 | | 5 | 25 | *500 | *3 | 641 | 758 | 22.2 | 43 | 16828 | 32594 |
| 64 | *F | | 820 | 25 | 670 | | | 420 | 16 | 562 | 902 | 27.6 | 53 | 24895 | 47806 |
| 65 | *H | | | | | 4 | | | *0 | 370 | 438 | 28.8 | 87 | 12614 | 38106 |
| 66 | *I | | 800 | 15 | 650 | 7 | 50 | 400 | 19 | 521 | 857 | 25.6 | 43 | 21939 | 36851 |
| 67 | *J | | | | | | | | *0 | 565 | 621 | 24.4 | 50 | 15152 | 31050 |

[1]γ: Volume fraction of retained austenite.
[2]YS: Yield Strength, TS: Tensile Strength, El: Elongation (Total)
[3]HEL: Hole Expansion Limit.
*Outside the range defined herein.
T·H: This Invention As can be seen from the results of Tables 3 and 4, hot rolled steel sheets according to this invention have improved hole expandability on the order of at least 80% in hole expansion limit while still having a high strength on the order of at least 600 MPa for tensile strength and good ductility of at least 30% in elongation (total elongation). Thus, they possess both high strength and good formability, and their TSxEl balance is at least on the order of 24,500 and in most cases as high as 30,000 or greater while their TSx HEL balance is at least 65,000 and often as high as 80,000 or greater.

It was confirmed that those hot rolled steel sheets according to this invention having an Si content of less than 1.0% had a good surface appearance free from high-Si scales.

Among the comparative steel sheets, those containing more than 0.3% C had deteriorated hole expandability, while those containing less than 0.05% C had a significantly low tensile strength. Insufficient addition of Al deteriorated the hole expandability. When the total contents of Si and Al are insufficient, the steel sheets was deteriorated in all respects of strength, elongation, and hole expandability. It was confirmed that excessive addition of Si deteriorated the surface quality extremely (Steel I). When the (Si+Al) content is excessive (Steel E), both elongation and hole expandability were deteriorated and it was confirmed that surface quality was also deteriorated. When the hot rolling conditions did not fall within the ranges defined herein, retention of austenite was insufficient and the resulting steel sheets did not have sufficient elongation or hole expandability.

EXAMPLE 2

This example illustrates the production of Cr-containing hot rolled steel sheets. Slabs of Cr-containing steels having the chemical compositions shown in Table 5 and made in the same manner as described in Example 1 were reheated at 1200° C. and subjected to hot rolling, control cooling, and coiling under the conditions shown in Tables 6 and 7 to obtain 2 mm-thick hot rolled steel sheets.

The tensile properties, hole expandability, and volume fraction of retained austenite of each hot rolled steel sheet were measured in the same way as described in Example 1.

In addition, the hot rolled steel sheets were tested for corrosion resistance. The test was performed by coating a test piece with a polyester resin-based coating composition and exposing the coated test piece to air for 3 years after the coated surface was scribed with crossed lines to a depth reaching the steel surface. The corrosion resistance was evaluated in terms of the largest width of the area in which the paint coating had been peeled off by the rust occurring along the crossed lines.

The test results are also shown in Tables 6 and 7. It can be seen that addition of Cr serves to improve corrosion resistance while maintaining high strength and good formability including high ductility and good hole expandability.

TABLE 5

| Steel No.[1] | | C | Si | Mn | Cr | P | S | Al | N | Si + Al | Mn + Cr |
|---|---|---|---|---|---|---|---|---|---|---|---|
| | | Chemical Composition (wt %) (Balance: Fe + Impurities) | | | | | | | | | |
| C | A | 0.15 | 1.48 | 1.10 | 1.21 | 0.019 | 0.002 | *0.05 | 0.0027 | 1.53 | 2.31 |
| E | B | 0.15 | 1.12 | 1.15 | 1.31 | 0.018 | 0.003 | 0.61 | 0.0032 | 1.73 | 2.46 |
| | C | 0.15 | 0.51 | 1.26 | 1.18 | 0.014 | 0.003 | 1.10 | 0.0035 | 1.61 | 2.44 |

TABLE 5-continued

| Steel | | Chemical Composition (wt %) (Balance: Fe + Impurities) | | | | | | | | | |
|---|---|---|---|---|---|---|---|---|---|---|---|
| | No.[1)] | C | Si | Mn | Cr | P | S | Al | N | Si + Al | Mn + Cr |
| | D | 0.14 | 0.12 | 1.22 | 1.15 | 0.015 | 0.003 | 1.53 | 0.0035 | 1.65 | 2.37 |
| C | E | 0.15 | 0.11 | 1.24 | 1.25 | 0.013 | 0.001 | *2.51 | 0.0067 | 2.62 | 2.49 |
| | F | 0.15 | 1.10 | 2.20 | *0.20 | 0.016 | 0.002 | 0.68 | 0.0013 | 1.78 | 2.40 |
| E | G | 0.19 | 1.13 | 0.42 | 2.10 | 0.015 | 0.002 | 0.65 | 0.0042 | 1.78 | 2.52 |
| | H | 0.18 | 1.15 | 0.06 | 2.52 | 0.018 | 0.002 | 0.70 | 0.0023 | 1.85 | 2.58 |
| C | I | 0.15 | 1.08 | 3.96 | 3.20 | 0.010 | 0.001 | *0.06 | 0.0041 | 1.14 | *7.16 |
| | J | *0.03 | 1.02 | 1.19 | 1.28 | 0.018 | 0.001 | 0.51 | 0.0035 | 1.53 | 2.47 |
| E | K | 0.12 | 1.13 | 1.23 | 1.21 | 0.012 | 0.002 | 0.43 | 0.0032 | 1.56 | 2.44 |
| | L | 0.27 | 1.06 | 1.14 | 1.32 | 0.013 | 0.002 | 0.55 | 0.0035 | 1.61 | 2.46 |
| C | M | *0.47 | 1.03 | 1.19 | 1.34 | 0.018 | 0.001 | 0.53 | 0.0024 | 1.56 | 2.53 |

[1)]C: Comparative Steel; E: This Invention Steel
*outside the range defined herein.

TABLE 6

| ** | | | Finish Rolling End | Cooling Rate After | Coil-ing | | Tensile Properties[2)] | | | | | | Corrosion |
|---|---|---|---|---|---|---|---|---|---|---|---|---|---|
| | Run No. | Steel No. | Temp. (°C.) | H. R. (°C./s) | Temp. (°C.) | γ[1)] (vol %) | YS (MPa) | TS (MPa) | El (%) | HEL[3)] (%) | TS × El | TS × HEL | Resistance (mm) |
| C | 1 | *A | 820 | 40 | 400 | 15 | 582 | 865 | 31 | 23 | 26815 | 19895 | 1.72 |
| | 2 | | *870 | | | *4 | 520 | 883 | 25 | 22 | 22075 | 19426 | 1.70 |
| E | 3 | B | 820 | | | 13 | 542 | 822 | 33 | 37 | 27126 | 30414 | 1.72 |
| | 4 | C | 840 | | | 12 | 546 | 831 | 34 | 37 | 28254 | 30747 | 1.78 |
| | 5 | | 800 | | 350 | 17 | 532 | 784 | 38 | 41 | 29792 | 32144 | 1.71 |
| | 6 | D | 820 | 20 | 400 | 18 | 469 | 720 | 44 | 44 | 31680 | 31680 | 1.79 |
| C | 7 | | *730 | | | *4 | 634 | 796 | 16 | 22 | 12736 | 17512 | 1.77 |
| | 8 | | 820 | *2 | | *1 | 521 | 703 | 22 | 46 | 15466 | 32338 | 1.70 |
| | 9 | | | *80 | *630 | *0 | 451 | 603 | 27 | 32 | 16281 | 19296 | 1.72 |
| | 10 | | | 40 | *80 | *4 | 500 | 912 | 13 | 15 | 11856 | 13680 | 1.77 |
| | 11 | *E | | | 400 | 19 | 403 | 620 | 39 | 31 | 24180 | 19220 | 1.72 |
| | 12 | *F | | | | 13 | 542 | 815 | 33 | 37 | 26895 | 30155 | 2.04 |
| E | 13 | G | | | | 14 | 562 | 853 | 34 | 36 | 29002 | 30708 | 1.46 |
| | 14 | H | | | | 14 | 548 | 855 | 33 | 36 | 28215 | 30780 | 1.41 |
| C | 15 | *I | | | | 19 | 615 | 1224 | 16 | 18 | 19584 | 22032 | 1.15 |
| | 16 | *J | | | | *2 | 410 | 680 | 28 | 48 | 19040 | 32640 | 1.70 |
| E | 17 | K | | | | 11 | 593 | 910 | 30 | 36 | 27300 | 32760 | 1.77 |
| | 18 | L | | | | 14 | 641 | 986 | 29 | 31 | 28594 | 30566 | 1.66 |
| C | 19 | *M | | | | 19 | 934 | 1408 | 21 | 14 | 29568 | 19712 | 1.74 |

*Outside the range define herein.
**C: Comparative Run. E: This Invention Run.
[1)]γ: Volume fraction of retained austenite.
[2)]YS: Yield Strength. TS: Tensile Strength. El: Elongation (Total).
[3)]HEL: Hole Expansion Limit.

TABLE 7

| ** | | | Finish Rolling End | Cool-ing Rate After | Air Cooling | | Cool-ing Rate After | Coil-ing | γ[1)] | Tensile Properties[2)] | | | | | | Corro-sion Resis- |
|---|---|---|---|---|---|---|---|---|---|---|---|---|---|---|---|---|
| | Run No. | Steel No. | Temp. (°C.) | H. R. (°C./s) | Temp. (°C.) | Dura-tion (sec) | A. C. (°C./s) | Temp. (°C.) | (vol %) | YS (MPa) | TS (MPa) | El (%) | HEL[3)] (%) | TS × El | TS × HEL | tance (mm) |
| C | 20 | *A | 820 | 40 | 670 | 6 | 60 | 400 | 23 | 582 | 872 | 36 | 22 | 31392 | 19184 | 1.76 |
| | 21 | | 900 | | | | | | *4 | 516 | 894 | 23 | 22 | 20562 | 19668 | 1.75 |
| E | 22 | B | 820 | | | | | | 22 | 540 | 835 | 37 | 37 | 30895 | 30895 | 1.71 |
| | 23 | C | 890 | | 650 | | | | 22 | 532 | 836 | 36 | 36 | 30096 | 30096 | 1.74 |
| | 24 | | 800 | 60 | | | | 350 | 25 | 526 | 792 | 39 | 38 | 30888 | 30096 | 1.69 |
| | 25 | D | 900 | 40 | 670 | 9 | 25 | 450 | 20 | 461 | 734 | 42 | 41 | 30828 | 30094 | 1.74 |

TABLE 7-continued

| ** Run No. | Steel No. | Finish Rolling End Temp. (°C.) | Cooling Rate After H. R. (°C./s) | Air Cooling Temp. (°C.) | Air Cooling Duration (sec) | Cooling Rate After A. C. (°C./s) | Coiling Temp. (°C.) | γ[1] (vol %) | Tensile Properties[2] YS (MPa) | TS (MPa) | El (%) | HEL[3] (%) | TS × El | TS × HEL | Corrosion Resistance (mm) |
|---|---|---|---|---|---|---|---|---|---|---|---|---|---|---|---|
| 26 | | 860 | 80 | | 2 | 40 | 400 | 23 | 487 | 756 | 43 | 42 | 32508 | 31752 | 1.78 |
| 27 | | 820 | 40 | | | 60 | | 24 | 567 | 723 | 44 | 43 | 31812 | 31089 | 1.76 |
| 28 | | | | 600 | 4 | 80 | | 24 | 558 | 744 | 42 | 43 | 31248 | 31992 | 1.76 |
| 29 | | | 20 | | 6 | 60 | | 25 | 561 | 761 | 42 | 42 | 31962 | 39162 | 1.72 |
| 30 | | 860 | 40 | 700 | | | 400 | 24 | 536 | 734 | 41 | 42 | 30094 | 30828 | 1.78 |
| C 31 | | *730 | | 670 | | | | *4 | 600 | 802 | 25 | 27 | 20050 | 21654 | 1.77 |
| 32 | | 820 | *2 | | | | | *3 | 517 | 700 | 27 | 43 | 18900 | 30100 | 1.79 |
| 33 | | | 40 | *520 | | | | *4 | 505 | 703 | 31 | 44 | 21793 | 30932 | 1.70 |
| 34 | | | | 670 | *30 | | | *4 | 516 | 1702 | 27 | 44 | 18954 | 30888 | 1.73 |
| 35 | | | | | 6 | *2 | | *1 | 531 | 708 | 28 | 43 | 19824 | 30444 | 1.74 |
| 36 | | | | | | 60 | *630 | *0 | 442 | 600 | 33 | 38 | 19800 | 22800 | 1.70 |
| 37 | *E | | | | | | 400 | 24 | 406 | 631 | 38 | 30 | 23978 | 18930 | 1.67 |
| 38 | *F | | | | | | | 20 | 531 | 812 | 37 | 38 | 30044 | 30856 | 2.01 |
| E 39 | G | | 60 | | | | | 22 | 564 | 866 | 35 | 36 | 30310 | 31176 | 1.49 |
| 40 | H | | 40 | | | 80 | | 22 | 523 | 867 | 37 | 36 | 32079 | 31212 | 1.35 |
| C 41 | *I | | | | | 60 | | 27 | 661 | 1311 | 16 | 16 | 20976 | 20976 | 1.16 |
| 42 | *J | | | | | | | *4 | 406 | 703 | 32 | 43 | 22496 | 30229 | 1.74 |
| E 43 | K | | | | | | | 22 | 598 | 936 | 33 | 34 | 30888 | 31824 | 1.71 |
| 44 | L | | | | | | 350 | 25 | 627 | 983 | 32 | 31 | 31456 | 30473 | 1.67 |
| C 45 | *M | | | | | | 400 | 29 | 986 | 1492 | 22 | 13 | 32824 | 19396 | 1.73 |

*Outside the range define herein.
**C: Comparative Run. E: This Invention Run.
[1]γ: Volume fraction of retained austenite.
[2]YS: Yield Strength. TS: Tensile Strength. El: Elongation (Total).
[3]HEL: Hole Expansion Limit.

EXAMPLE 3

Steels having the chemical compositions given in Table 8 were prepared by melting in a vacuum melting furnace and were subjected to hot forging to form 25 mm-thick slabs for experiments. After the slabs were heated at 1250° C. for 1 hour in an electric furnace, they were subjected to 3-pass hot rolling in the temperature range of 1150° –930° C. to form 3.2 mm-thick hot rolled steel sheets. As a simulation of coiling, the steel sheets immediately after hot rolling were cooled to 500° C. by forced air cooling or water spraying, kept for 1 hour at that temperature in an electric furnace, and cooled in the furnace at a rate of 20° C./hr.

The resulting hot rolled steel sheets were descaled by pickling the steel sheets with a 15% hydrochloric acid solution at 80° C. and the pickled sheets were used as stocks in cold rolling. Cold rolling was performed to reduce the thickness to 1.4 mm with a reduction of 56%.

As a simulation of continuous annealing, the cold rolled steel sheets were placed in an infrared heating furnace in which they were heated to 800° C. at a rate of 10° C./sec, kept for 40 seconds at that temperature, slowly cooled to 700° C. at a rate of 3° C./sec, then cooled to 400° C. at a rate of 50° C./sec, and kept for 3 minutes at that temperature. Thereafter, the annealed steel sheets were cooled in the furnace to a temperature below 200° C. at a rate of 10° C./sec.

The tensile properties and volume fraction of retained austenite of each cold rolled and annealed steel sheet were determined in the same manner as described in Example 1. In the tensile test, values for uniform elongation and local elongation were also determined in addition to total elongation, which may be referred to merely as elongation. The uniform elongation was calculated by determining the "n-value" from the ratio of the load applied at 10% elongation to that at 20% elongation and converting the n-value into elongation. The local elongation was calculated by subtracting the value for uniform elongation from the value for total elongation.

A hole expansion test was performed by preparing a 70 mm-square test piece (blank) having a hole 10 mm in diameter punched with a clearance of 0.1 mm and expanding the hole by forcing a punch 33 mm in diameter into the hole while the test piece was held with a die having an inner diameter of 36.5 mm at a blank holder pressure of 3 tons. The hole expansion limit (HEL) was determined in the same way as described in Example 1.

Figure 2:
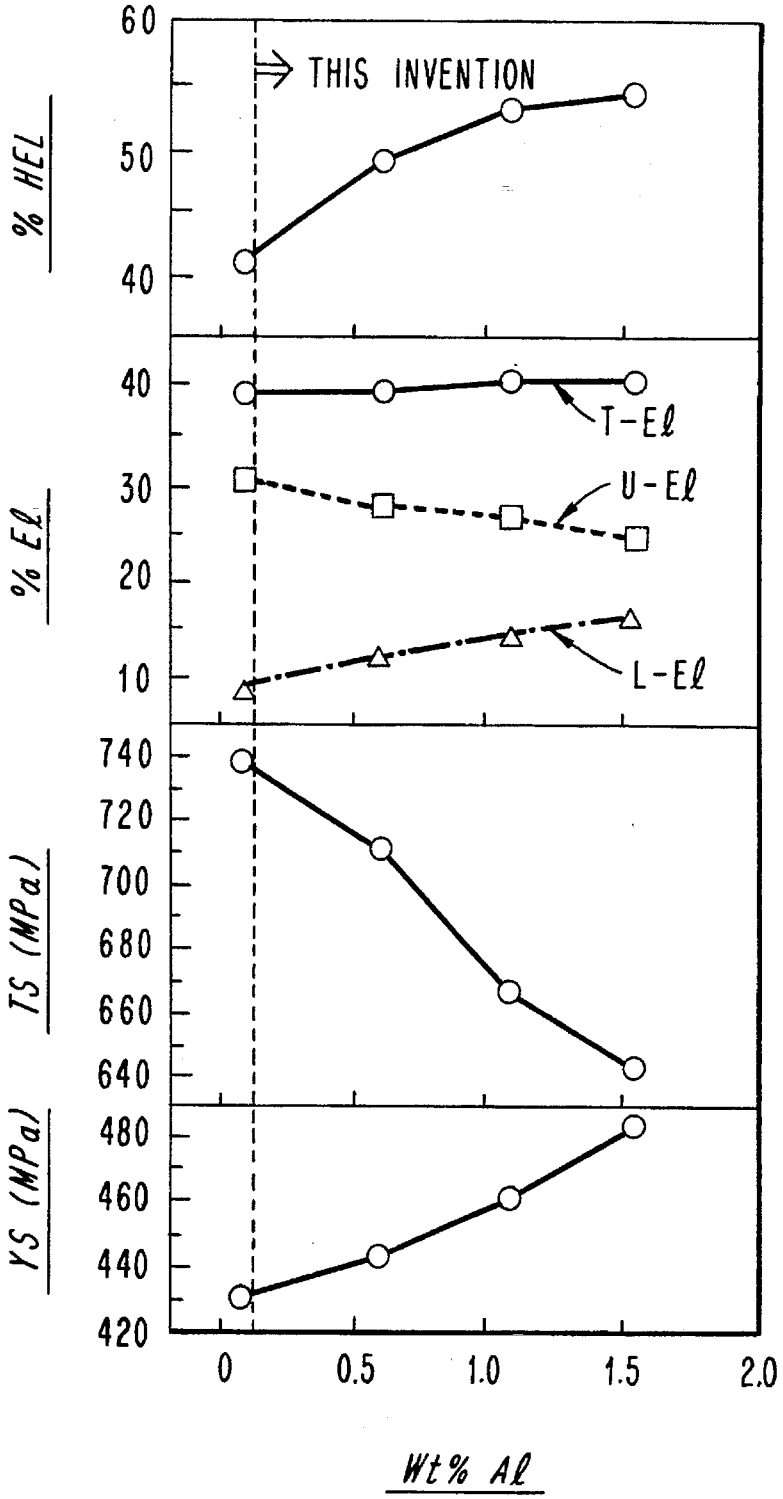
FIG. 2 shows the effects of Al content on hole expansion limit (abbreviated as HEL), total elongation (El), tensile strength (TS), and yield strength (YS)

The test results are given in Table 9. Some of the results are also shown in FIG. 2 as a function of Al content varying in the range of 0.07–1.54% with an approximately constant (Si+Al) content.

TABLE 8

| Steel No.[1] | | C | Si | Mn | P | S | Al | N | Si + Al | $Ac_1$ (°C.) | $Ac_3$ (°C.) |
|---|---|---|---|---|---|---|---|---|---|---|---|
| | | Chemical Composition (wt %) (Balance: Fe + Impur.) | | | | | | | | | |
| C | 1 | 0.18 | 1.49 | 1.43 | 0.015 | 0.001 | *0.07 | 0.0041 | 1.56 | 767 | 861 |
| E | 2 | 0.19 | 1.18 | 1.45 | 0.016 | 0.001 | 0.35 | 0.0045 | 1.53 | 742 | 856 |

TABLE 8-continued

| Steel | | Chemical Composition (wt %) (Balance: Fe + Impur.) | | | | | | | | $Ac_1$ | $Ac_3$ |
|---|---|---|---|---|---|---|---|---|---|---|---|
| | No.[1)] | C | Si | Mn | P | S | Al | N | Si + Al | (°C.) | |
| | 3 | 0.18 | 0.98 | 1.50 | 0.016 | 0.002 | 0.59 | 0.0037 | 1.57 | 735 | 857 |
| | 4 | 0.18 | 0.75 | 1.48 | 0.015 | 0.001 | 0.75 | 0.0035 | 1.50 | 729 | 853 |
| | 5 | 0.19 | 0.49 | 1.50 | 0.015 | 0.001 | 1.08 | 0.0047 | 1.57 | 728 | 852 |
| | 6 | 0.20 | 0.22 | 1.56 | 0.016 | 0.001 | 1.30 | 0.0042 | 1.52 | 713 | 845 |
| | 7 | 0.20 | 0.11 | 1.47 | 0.016 | 0.001 | 1.54 | 0.0084 | 1.65 | 717 | 853 |
| C | 8 | 0.19 | 0.10 | 1.52 | 0.017 | 0.002 | *2.50 | 0.0070 | 2.60 | 717 | 892 |
| E | 9 | 0.18 | 0.11 | 1.36 | 0.016 | 0.002 | 1.09 | 0.0045 | 1.20 | 712 | 843 |
| | 10 | 0.19 | 0.12 | 1.35 | 0.016 | 0.001 | 0.71 | 0.0046 | 0.83 | 712 | 826 |
| | 11 | 0.19 | 0.10 | 1.85 | 0.017 | 0.001 | 0.62 | 0.0048 | 0.72 | 706 | 807 |
| C | 12 | 0.18 | 0.10 | 1.96 | 0.015 | 0.001 | *0.06 | 0.0050 | *0.16 | 717 | 783 |
| E | 13 | 0.18 | 0.52 | 1.32 | 0.014 | 0.001 | 0.38 | 0.0048 | 0.90 | 724 | 832 |
| | 14 | 0.19 | 0.55 | 1.35 | 0.013 | 0.002 | 0.56 | 0.0050 | 1.11 | 725 | 837 |
| | 15 | 0.17 | 0.56 | 1.40 | 0.015 | 0.002 | 0.75 | 0.0035 | 1.31 | 724 | 850 |
| | 16 | 0.18 | 0.58 | 1.29 | 0.016 | 0.001 | 1.23 | 0.0038 | 1.81 | 726 | 872 |
| C | 17 | *0.04 | 1.52 | 1.50 | 0.003 | 0.002 | 0.51 | 0.0032 | 2.03 | 758 | 913 |
| E | 18 | 0.11 | 1.43 | 1.62 | 0.006 | 0.003 | 0.43 | 0.0040 | 1.86 | 756 | 879 |
| | 19 | 0.28 | 1.56 | 1.54 | 0.001 | 0.003 | 0.55 | 0.0035 | 2.11 | 759 | 849 |
| C | 20 | *0.48 | 1.03 | 1.55 | 0.001 | 0.003 | 0.53 | 0.0034 | 1.56 | 744 | 791 |

[1)]C: Comparative Steel; E: This Invention Steel
*Outside the range defined herein.

TABLE 9

| Steel | | Tensile Properties[2)] | | | | | | | | |
|---|---|---|---|---|---|---|---|---|---|---|
| | No.[1)] | YS (MPa) | TS (MPa) | T-El (%) | U-El (%) | L-El (%) | HEL[3)] (%) | TS × El | TS × HEL | γ[4)] (vol %) |
| C | 1 | 430 | 738 | 39 | 30 | 9 | 34 | 28782 | 25092 | 21 |
| E | 2 | 435 | 725 | 39 | 28 | 11 | 47 | 28392 | 34075 | 20 |
| | 3 | 442 | 710 | 39 | 27 | 12 | 49 | 27690 | 34790 | 20 |
| | 4 | 451 | 687 | 40 | 26 | 14 | 52 | 27480 | 35724 | 21 |
| | 5 | 460 | 665 | 40 | 26 | 14 | 53 | 26600 | 35245 | 21 |
| | 6 | 475 | 648 | 40 | 25 | 15 | 54 | 25920 | 34992 | 20 |
| | 7 | 482 | 641 | 40 | 24 | 16 | 54 | 25640 | 34614 | 19 |
| C | 8 | 490 | 645 | 35 | 25 | 10 | 45 | 22575 | 29025 | 10 |
| E | 9 | 450 | 685 | 40 | 29 | 11 | 45 | 27400 | 30825 | 20 |
| | 10 | 483 | 725 | 39 | 28 | 11 | 44 | 28275 | 31900 | 18 |
| | 11 | 598 | 740 | 37 | 28 | 9 | 43 | 27380 | 31820 | 15 |
| C | 12 | 659 | 767 | 17 | 13 | 4 | 35 | 13039 | 36845 | *3 |
| E | 13 | 434 | 642 | 38 | 27 | 11 | 43 | 24396 | 27606 | 16 |
| | 14 | 449 | 652 | 38 | 26 | 12 | 46 | 24776 | 29992 | 17 |
| | 15 | 455 | 660 | 39 | 25 | 14 | 47 | 25740 | 31020 | 19 |
| | 16 | 462 | 672 | 40 | 26 | 14 | 49 | 26880 | 32928 | 19 |
| C | 17 | 331 | 441 | 35 | 23 | 12 | 75 | 15435 | 33075 | *2 |
| E | 18 | 417 | 660 | 31 | 16 | 15 | 63 | 20460 | 41580 | 16 |
| | 19 | 642 | 1052 | 27 | 15 | 12 | 36 | 28404 | 37872 | 26 |
| C | 20 | 674 | 1086 | 14 | 10 | 4 | 13 | 15204 | 14118 | 22 |

[1)]C: Comparative Steel; E: This Invention Steel.
[2)]YS: Yield Strength. TS: Tensile Strength. T-El: Total Elongation. U-El: Uniform Elongation. L-El: Local Elongation.
[3)]HEL: Hole Expansion Limit.
[4)]γ: Volume fraction of retained austenite.
*outside the range defined herein.

Also in the case of cold rolled steel sheets, addition of Al and Si together in accordance with this invention provided the steel sheets with improved ductility and hole expandability, and caused the steel sheets to have a significantly increased TSxHel balance, while substantially maintaining a high tensile strength. An increase in Al content with a decrease in Si content so as to keep an approximately constant (Si+Al) content had an effect of increasing the hole expansion limit without a significant variation in total elongation. Such improved hole expandability seem to correlate with increased local elongation. However, excessive addition of Al resulted in a decreased total elongation and deteriorated hole expandability. When the (Si+Al) content was excessively low, the ductility was decreased.

EXAMPLE 4

This example illustrates Cu-containing cold rolled steel sheets according to this invention, which had the chemical compositions given in Table 10 and which were produced in exactly the same manner as described in Example 3.

In the course of the hot rolling stage, the surface roughness of each hot rolled steel sheet after pickling with a 15% hydrochloric acid solution was determined and the pickled steel surface and end faces were visually observed to determine the presence or absence of cracks.

The cold rolled and annealed steel sheets were subjected to a tensile test, hole expansion test, and wet box cycled corrosion test. The tensile test and hole expansion test were carried out in the same manner as described in Examples 1 and 3, respectively.

The wet box cycled corrosion test was conducted by exposing test pieces to air for 3 months while subjecting them to salt spraying twice a week. The corrosion resistance was evaluated in terms of corrosion depth after the test.

Figure 3:
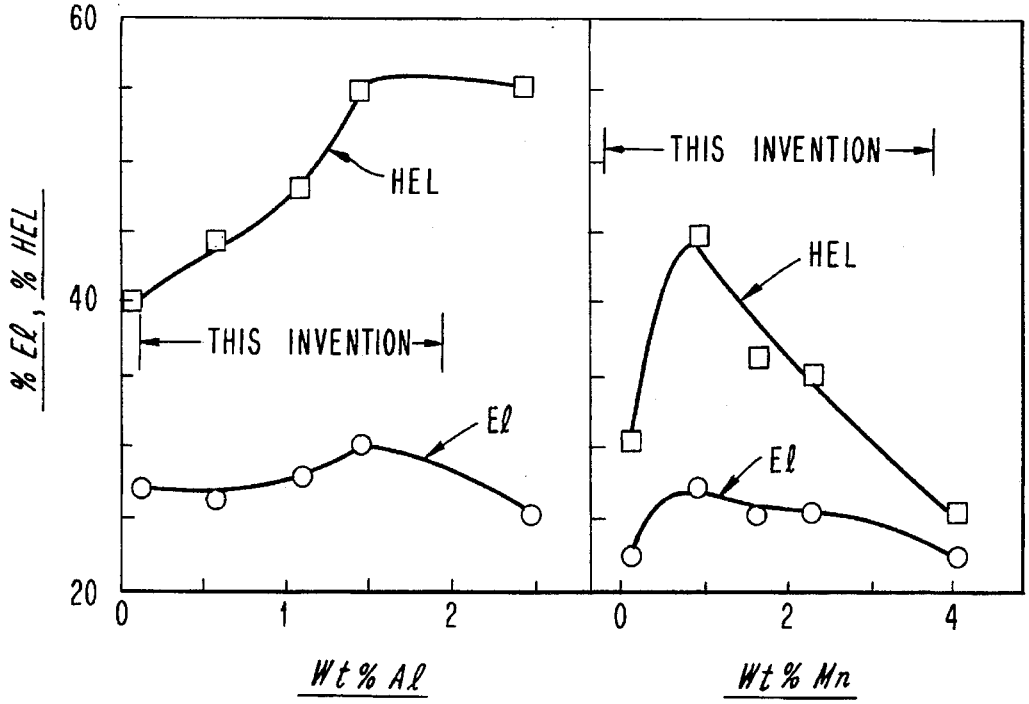
FIG. 3 shows the effects of Al and Mn contents on hole expansion limit (HEL) and total elongation (El).

The test results are summarized in Table 11. Some of the results are also shown in FIG. 3, which shows the influences of Al and Mn content on ductility and hole expandability with an approximately constant (Si+Al) content.

TABLE 10

| Steel | | Chemical Composition (wt %) (Balance: Fe + Impurities) | | | | | | | | | | | $Ac_1$ | $Ac_3$ |
|---|---|---|---|---|---|---|---|---|---|---|---|---|---|---|
| | No.[1)] | C | Si | Mn | Cu | P | S | Al | N | Ni | Si + Al | Mn + Ni | (°C.) | |
| E | 1 | 0.19 | 0.25 | 1.45 | 0.12 | 0.012 | 0.003 | 0.52 | 0.0035 | 0.05 | 0.77 | 1.50 | 732 | 818 |
| | 2 | 0.18 | 0.35 | 1.52 | 0.36 | 0.010 | 0.005 | 0.56 | 0.0036 | 0.20 | 0.91 | 1.72 | 732 | 820 |
| | 3 | 0.19 | 0.36 | 1.56 | 0.35 | 0.009 | 0.006 | 0.76 | 0.0042 | 0.20 | 1.12 | 1.76 | 733 | 824 |
| | 4 | 0.18 | 0.58 | 1.54 | 0.38 | 0.015 | 0.005 | 0.75 | 0.0039 | 0.21 | 1.33 | 1.75 | 726 | 841 |
| | 5 | 0.17 | 0.55 | 1.48 | 0.56 | 0.013 | 0.008 | 0.78 | 0.0029 | 0.22 | 1.33 | 1.70 | 727 | 843 |
| | 6 | 0.19 | 1.04 | 1.40 | 0.25 | 0.018 | 0.003 | 0.80 | 0.0030 | 0.00 | 1.84 | 1.40 | 742 | 879 |
| | 7 | 0.19 | 1.05 | 1.35 | 0.39 | 0.015 | 0.004 | 0.65 | 0.0029 | 0.00 | 1.70 | 1.35 | 746 | 873 |
| C | 8 | 0.18 | 1.47 | 1.10 | 0.51 | 0.017 | 0.003 | *0.08 | 0.0027 | 0.21 | 1.55 | 1.31 | 754 | 877 |
| E | 9 | 0.18 | 1.13 | 1.15 | 0.50 | 0.016 | 0.002 | 0.60 | 0.0032 | 0.19 | 1.73 | 1.34 | 741 | 874 |
| | 10 | 0.19 | 0.53 | 1.26 | 0.57 | 0.018 | 0.003 | 1.12 | 0.0042 | 0.21 | 1.65 | 1.47 | 727 | 867 |
| | 11 | 0.19 | 0.11 | 1.22 | 0.50 | 0.016 | 0.003 | 1.48 | 0.0023 | 0.22 | 1.59 | 1.44 | 719 | 866 |
| C | 12 | 0.19 | 0.11 | 1.24 | 0.53 | 0.015 | 0.002 | *2.51 | 0.0035 | 0.20 | 2.62 | 1.44 | 719 | 899 |
| | 13 | 0.18 | 1.10 | 0.32 | 0.56 | 0.016 | 0.002 | 0.68 | 0.0035 | 0.10 | 1.78 | *0.42 | 751 | 904 |
| E | 14 | 0.19 | 1.13 | 1.85 | 0.52 | 0.015 | 0.003 | 0.65 | 0.0067 | 0.23 | 1.78 | 2.08 | 732 | 857 |
| | 15 | 0.18 | 1.15 | 2.52 | 0.58 | 0.018 | 0.002 | 0.70 | 0.0013 | 0.21 | 1.85 | 2.73 | 735 | 843 |
| C | 16 | 0.18 | 1.08 | *4.30 | 0.59 | 0.016 | 0.002 | 0.32 | 0.0025 | 0.20 | 1.40 | 4.50 | 713 | 771 |
| | 17 | 0.17 | 1.06 | 1.12 | *0.01 | 0.016 | 0.003 | 0.52 | 0.0032 | 0.01 | 1.58 | 1.13 | 746 | 875 |
| E | 18 | 0.18 | 1.07 | 1.23 | 1.02 | 0.015 | 0.002 | 0.42 | 0.0041 | 0.41 | 1.49 | 1.64 | 735 | 856 |
| | 19 | 0.19 | 1.08 | 1.16 | 1.53 | 0.016 | 0.002 | 0.43 | 0.0035 | 0.67 | 1.51 | 1.83 | 737 | 868 |
| C | 20 | 0.18 | 1.08 | 1.13 | 1.52 | 0.015 | 0.002 | 0.45 | 0.0032 | *0.20 | 1.53 | 1.33 | 742 | 873 |
| | 21 | *0.04 | 1.02 | 1.19 | 1.03 | 0.018 | 0.002 | 0.51 | 0.0028 | 0.40 | 1.53 | 1.59 | 738 | 911 |
| E | 22 | 0.13 | 1.13 | 1.23 | 1.08 | 0.012 | 0.003 | 0.43 | 0.0024 | 0.42 | 1.56 | 1.65 | 738 | 872 |
| | 23 | 0.22 | 1.06 | 1.14 | 1.06 | 0.013 | 0.004 | 0.55 | 0.0035 | 0.42 | 1.61 | 1.56 | 743 | 855 |
| C | 24 | *0.45 | 1.03 | 1.19 | 1.01 | 0.018 | 0.002 | 0.53 | 0.0035 | 0.37 | 1.56 | 1.56 | 736 | 817 |

[1)]C: Comparative Steel; E: This Invention Steel
*outside the range defined herein.

TABLE 11

| Steel | | Tensile Properties[2] | | | | | Hot Rolled Sheet | | | | | |
|---|---|---|---|---|---|---|---|---|---|---|---|---|
| | No.[1)] | YS (MPa) | TS (MPa) | YR (%) | El (%) | HEL[3] (%) | Surface Roughness[4] | Cracks[5] | CCT[5] (mm) | TS × El | TS × HEL | $\gamma^7$ (vol %) |
| E | 1 | 581 | 700 | 83 | 30 | 51 | ◎ | ○ | 0.32 | 21000 | 36700 | 20 |
| | 2 | 568 | 691 | 82 | 30 | 52 | ◎ | ○ | 0.26 | 20730 | 35932 | 20 |
| | 3 | 589 | 717 | 82 | 29 | 49 | ◎ | ○ | 0.26 | 20793 | 35133 | 21 |
| | 4 | 574 | 715 | 80 | 29 | 49 | ◎ | ○ | 0.27 | 20735 | 35035 | 20 |
| | 5 | 553 | 686 | 81 | 31 | 53 | ◎ | ○ | 0.22 | 21266 | 35658 | 19 |
| | 6 | 578 | 771 | 75 | 27 | 41 | ○ | ○ | 0.32 | 20817 | 31611 | 20 |
| | 7 | 617 | 775 | 80 | 27 | 40 | ○ | ○ | 0.29 | 20925 | 31000 | 20 |
| C | 8 | 564 | 782 | 72 | 27 | 35 | ○ | ○ | 0.28 | 21114 | 27370 | 19 |
| E | 9 | 569 | 750 | 76 | 27 | 44 | ○ | ○ | 0.26 | 20250 | 33000 | 19 |
| | 10 | 579 | 718 | 81 | 28 | 48 | ◎ | ○ | 0.22 | 20104 | 34464 | 20 |
| | 11 | 580 | 674 | 86 | 30 | 55 | ◎ | ○ | 0.21 | 20220 | 37070 | 20 |
| C | 12 | 572 | 675 | 85 | 25 | 55 | ◎ | ○ | 0.21 | 16875 | 37125 | 20 |
| | 13 | 545 | 836 | 65 | 22 | 30 | ○ | ○ | 0.25 | 18392 | 25080 | 18 |
| E | 14 | 644 | 808 | 80 | 25 | 36 | ○ | ○ | 0.26 | 20200 | 29088 | 21 |

TABLE 11-continued

| | Steel No.[1] | Tensile Properties[2] YS (MPa) | TS (MPa) | YR (%) | El (%) | HEL[3] (%) | Hot Rolled Sheet Surface Roughness[4] | Cracks[5] | CCT[5] (mm) | TS × El | TS × HEL | γ[7] (vol %) |
|---|---|---|---|---|---|---|---|---|---|---|---|---|
| | 15 | 642 | 821 | 78 | 25 | 35 | ○ | ○ | 0.25 | 20525 | 28735 | 21 |
| C | 16 | 656 | 903 | 73 | 22 | 25 | ○ | ○ | 0.24 | 19866 | 22575 | 23 |
| | 17 | 568 | 719 | 79 | 29 | 48 | X | ○ | 0.38 | 20851 | 34512 | 19 |
| E | 18 | 571 | 748 | 76 | 28 | 44 | ○ | ○ | 0.13 | 20944 | 32912 | 20 |
| | 19 | 564 | 769 | 73 | 27 | 41 | ⊙ | ○ | 0.05 | 20763 | 31529 | 21 |
| C | 20 | 552 | 745 | 74 | 28 | 45 | ⊙ | X | 0.06 | 20860 | 33525 | 19 |
| | 21 | 317 | 426 | 74 | 48 | 101 | ○ | ○ | 0.13 | 20448 | 43026 | 6 |
| E | 22 | 490 | 642 | 76 | 32 | 60 | ○ | ○ | 0.12 | 20544 | 38520 | 15 |
| | 23 | 653 | 833 | 78 | 25 | 33 | ○ | ○ | 0.12 | 20825 | 27489 | 24 |
| C | 24 | 1032 | 1350 | 76 | 12 | 2 | ○ | ○ | 0.13 | 16200 | 2700 | 47 |

[1]C: Comparative Steel; E: This Invention Steel
[2]YS: Yield Strength, TS: Tensile Strength, YR: Yield Ratio, El: Elongation.
[3]HEL: Hole Expansion Limit.
[4]Surface Roughness: ⊙ - less than 10 μm. ○ - 10~50 μm. X - Greater than 50 μm.
[5]Cracks: ○ - Not cracked. X - Cracked.
[6]CCT = Corrosion depth in wet box cycled corrosion test.
[7]γ: Volume fraction of retained austenite.

Addition of Cu had an effect of improving the corrosion resistance and surface roughness while maintaining good ductility and hole expandability.

Apart from the above experiment, the cold rolled steel sheets produced in this example were subjected to a continuous galvanizing test. All the steel sheets according to this invention had good wettability with respect to molten zinc and good processability in the subsequent heat treatment for alloying.

It will be appreciated by those skilled in the art that numerous variations and modifications may be made to the invention as described above with respect to specific embodiments without departing from the spirit or scope of the invention as broadly described.

What is claimed is:

1. A high tensile strength steel sheet having improved ductility and hole expandability, which consists essentially, on a weight basis, of:

C: 0.05–0.3%, Si: less than 1.0%, Mn: 0.05–4%,

Al: greater than 0.10% and not greater than 2.0% wherein $$0.5 \leqq Si(\%)+Al(\%) \leqq 3.0,$$

Cu: 0–2.0%, Ni: 0–1.0% and $Ni(\%) \geqq Cu(\%)/3$,

Cr: 0–5.0%, Ca: 0–0.01%, Zr: 0–0.10%, rare earth metal (REM): 0–0.10%, Nb: 0–0.10%, Ti: 0–0.10%, V: 0–0.20%, and a balance of Fe and inevitable impurities with N being limited to 0.01% or less, the steel sheet having a structure which comprises at least 5% by volume of retained austenite.

2. The high tensile strength steel sheet of claim 1, which comprises:

C: 0.10–0.25%, Si: less than 1.0%, Mn: 0.5–2.5%, and

Al: 0.25–2.0% and $1.0 \leqq Si(\%)+Al(\%) \leqq 2.5$.

3. The high tensile strength steel sheet of claim 2, wherein the structure comprises at least 10% by volume of retained austenite.

4. The high tensile strength steel sheet of claim 2, wherein the inevitable impurities comprise: N: 0.005% or less, P: 0.02% or less, and S: 0.01% or less.

5. A high tensile strength steel sheet having improved ductility and hole expandability, which consists essentially, on a weight basis, of:

C: 0.10–0.25%, Si: 2.0% or less, Mn: 0.5–2.5%,

Al: 0.25–2.0% wherein $$1.0 \leqq Si(\%)+Al(\%) \leqq 2.5,$$

Cu: 0.1–2.0%, Ni: 0–1.0% and $Ni(\%) \geqq Cu(\%)/3$,

Cr: 0–5.0%, Ca: 0–0.01%, Zr: 0–0.10%, rare earth metal (REM): 0–0.10%, Nb: 0–0.10%, Ti: 0–0.10%, V: 0–0.20%, and a balance of Fe and inevitable impurities with N being limited to 0.01% or less, the steel sheet having a structure which comprises at least 5% by volume of retained austenite and $Cu(\%) \geqq Si(\%)/5$.

6. The high tensile strength steel sheet of claim 5, which comprises Ni in an amount of up to 1.0% and satisfies $Ni(\%) \geqq Cu(\%)/3$ when $Cu(\%)>0.5$, and $Mn(\%)+Ni(\%) \geqq 0.5$.

7. The high tensile strength steel sheet of claim 2, which comprises Cr in an amount in the range of 0.5–5.0% and satisfies $7.0 \geqq Mn(\%)+Cr(\%) \geqq 1.0$.

8. A high tensile strength steel sheet having improved ductility and hole expandability, which consists essentially, on a weight basis, of:

C: 0.10–0.25%, Si: 2.0 or less, Mn: 0.5–2.5%,

Al: 0.25–2.0% wherein $$1.0 \leqq Si(\%)+Al(\%) \leqq 2.5,$$

Cu: 0–2.0%, Ni: 0–1.0% and $Ni(\%) \geqq Cu(\%)/3$,

Cr: 0–5.0%, Ca: 0–0.01%, Zr: 0–0.10%, rare earth metal (REM): 0–0.10%, Nb: 0–0.10%, Ti: 0–0.10%, V: 0–0.20%, and a balance of Fe and inevitable impurities with N being limited to 0.01% or less, the steel sheet having a structure which comprises at least 5% by volume of retained austenite and the steel including one or more elements selected from the group consisting of Ca: 0.002–0.01%, Zr: 0.01–0.10%, and REM: 0.01–0.10%.

9. A high tensile strength steel sheet having improved ductility and hole expandability, which consists essentially, on a weight basis, of:

C: 0.10–0.25%, Si: 2.0% or less, Mn: 0.5–2.5%,

Al: 0.25–2.0% wherein $$1.0 \leqq Si(\%)+Al(\%) \leqq 2.5,$$

Cu: 0–2.0%, Ni: 0–1.0% and Ni(%)≧Cu(%)/3,

Cr: 0–5.0%, Ca: 0–0.01%, Zr: 0–0.10%, rare earth metal (REM): 0–0.10%, Nb: 0–0.10%, Ti: 0–0.10%, V: 0–0.20%, and a balance of Fe and inevitable impurities with N being limited to 0.01% or less, the steel sheet having a structure which comprises at least 5% by volume of retained austenite and the steel including one or more elements selected from the group consisting of Nb: 0.005–0.10%, Ti: 0.005–0.10%, and V: 0.0005–0.20%.

10. The high tensile strength steel sheet of claim 1, which comprises:

C: 0.10–0.20%, Si: not less than 0.2% and less than 1.0%

Mn: 0.5–2.0%, and

Al: 0.50–1.5% and 1.5≦Si(%)+Al(%)≦2.5.

11. The high tensile strength steel sheet of claim 10, wherein the structure comprises at least 15% by volume of retained austenite.

12. The high tensile strength steel sheet of claim 10, which comprises Cu in an amount in the range of 0.1–0.6% and satisfies Cu(%)≧Si(%)/5.

13. The high tensile strength steel sheet of claim 12, which comprises Ni in an amount of up to 0.5% and satisfies Ni(%)≧Cu(%)/3 when Cu(%)≧0.5, and Mn(%)+Ni(%)≧0.5.

14. The high tensile strength steel sheet of claim 10, which comprises Cr in an amount in the range of 0.6–1.6% and satisfies 3.0≧Mn(%)+Cr(%)≧1.0.

15. The high tensile strength steel sheet of claim 10, which comprises Si in an amount of 0.2–0.9%.

16. A high tensile strength, hot rolled steel sheet having improved ductility and hole expandability, which consists essentially, on a weight basis, of:

C: 0.05–0.3%, Si: not less than 0.2% and less than 1.0%, Mn: 0.05–4%,

Al: greater than 0.10% and not greater than 2.0% wherein $$0.5 \leqq Si(\%)+Al(\%) \leqq 3.0,$$

Cr: 0–5.0%, Ca: 0–0.01%, Zr: 0–0.10%, rare earth metal (REM): 0–0.10%, Nb: 0–0.10%, Ti: 0–0.10%, V: 0–0.20%, and a balance of Fe and inevitable impurities with N being limited to 0.01% or less, the steel sheet having a structure which comprises at least 5% by volume of retained austenite.

17. The high tensile strength steel sheet of claim 16, which comprises Cr in an amount in the range of 0.5–5.0% and satisfies 7.0≧Mn(%)+Cr(%)≧1.0.

18. The high tensile strength steel sheet of claim 16, which comprises one or more elements selected from the group consisting of Ca: 0.0002–0.01%, Zr: 0.01–0.10%, and REM: 0.01–0.10%.

19. The high tensile strength steel sheet of claim 16, which comprises one or more elements selected from the group consisting of Nb: 0.005–0.10%, Ti: 0.005–0.10%, and V: 0.005–0.20%.

20. The high tensile strength steel sheet of claim 16, which comprises Si in an amount of 0.2–0.9%.

21. A high tensile strength, cold rolled steel sheet having improved ductility and hole expandability, which consists essentially, on a weight basis, of:

C: 0.05–0.3%, Si: 2.5% or less, Mn: 0.05–4%,

Al: greater than 0.10% and not greater than 2.0% wherein $$0.5 \leqq Si(\%)+Al(\%) \leqq 3.0,$$

Cu: 0.1–2.0% and Cu(%)≧Si(%)/5, Ni: 0–1.0% and Ni(%)≧Cu(%)/3, and a balance of Fe and inevitable impurities with N being limited to 0.01% or less, the steel sheet having a structure which comprises at least 5% by volume of retained austenite.

22. The high tensile strength steel sheet of claim 21, which comprises Ni in amount of up to 1.0% and satisfies Ni(%)≧Cu(%)/3 when Cu(%)>0.5, and Mn(%)+Ni(%)≧0.5.

23. The high tensile strength steel sheet of claim 1, which is a hot rolled steel sheet.

24. The high tensile strength steel sheet of claim 5, which is a hot rolled steel sheet.

25. The high tensile strength steel sheet of claim 8, which is a hot rolled steel sheet.

26. The high tensile strength steel sheet of claim 9, which is a hot rolled steel sheet.

27. The high tensile strength steel sheet of claim 10, which is a hot rolled steel sheet.

28. The high tensile strength steel sheet of claim 1, which is a cold rolled steel sheet.

29. The high tensile strength steel sheet of claim 5, which is a cold rolled steel sheet.

30. The high tensile strength steel sheet of claim 8, which is a cold rolled steel sheet.

31. The high tensile strength steel sheet of claim 9, which is a cold rolled steel sheet.

32. The high tensile strength steel sheet of claim 10, which is a cold rolled steel sheet.

33. The high tensile strength steel sheet of claim 5, which comprises Cr in an amount in the range of 0.5–5.0% and satisfies 7.0≧Mn(%)+Cr (%)≧1.0.

34. The high tensile strength steel sheet of claim 8, which comprises Cr in an amount in the range of 0.5–5.0% and satisfies 7.0≧Mn(%)+Cr (%)≧1.0.

35. The high tensile strength steel sheet of claim 9, which comprises Cr in an amount in the range of 0.5–5.0% and satisfies 7.0≧Mn(%)+Cr (%)≧1.0.

36. The high tensile strength steel sheet of claim 5, which comprises one or more elements selected from the group consisting of Ca: 0.0002–0.01%, Zr: 0.01–0.1%, and REM: 0.01–0.10%.

37. The high tensile strength steel sheet of claim 9, which comprises one or more elements selected from the group consisting of Ca: 0.0002–0.01%, Zr: 0.01–0.1%, and REM: 0.01–0.10%.

38. The high tensile strength steel sheet of claim 5, which comprises one or more elements selected from the group consisting of Nb: 0.005–0.10%, Ti: 0.005–0.10%, and V: 0.005–0.20%.

39. The high tensile strength steel sheet of claim 8, which comprises one or more elements selected from the group consisting of Nb: 0.005–0.10%, Ti: 0.005–0.10%, and V: 0.005–0.20%.

40. The high tensile strength steel sheet of claim 5, which comprises Si in an amount of not less than 0.2% and less than 1.0%.

41. The high tensile strength steel sheet of claim 5, which comprises Si in an amount of 0.2–0.9%.

42. The high tensile strength steel sheet of claim 8, which comprises Si in an amount of not less than 0.2% and less than 1.0%.

43. The high tensile strength steel sheet of claim 8, which comprises Si in an

44. The high tensile strength steel sheet of claim 9, which comprises Si in an amount of not less than 0.2% and less than 1.0%.

45. The high tensile strength steel sheet of claim 9, which comprises Si in an amount of 0.2–0.9%.

* * * * *